US007811027B2

(12) United States Patent
Scheiwiller

(10) Patent No.: US 7,811,027 B2
(45) Date of Patent: Oct. 12, 2010

(54) SET OF PAVING STONES

(76) Inventor: Rolf Scheiwiller, Buolterlistrasse 9, CH-6052 Hergiswil (CH)

( * ) Notice: Subject to any disclaimer, the term of this patent is extended or adjusted under 35 U.S.C. 154(b) by 0 days.

(21) Appl. No.: 11/941,339

(22) Filed: Nov. 16, 2007

(65) Prior Publication Data

US 2008/0101860 A1 May 1, 2008

Related U.S. Application Data

(63) Continuation of application No. PCT/EP2006/004403, filed on May 11, 2006.

(30) Foreign Application Priority Data

| | | |
|---|---|---|
| May 18, 2005 | (DE) | 10 2005 023 565 |
| Nov. 15, 2005 | (DE) | 10 2005 054 384 |
| Dec. 21, 2005 | (DE) | 10 2005 061 711 |

(51) Int. Cl.
*E01C 5/00* (2006.01)
*E04B 5/04* (2006.01)

(52) U.S. Cl. ..... 404/38; 404/41; 404/42; 52/603; 52/604

(58) Field of Classification Search ..... 404/34, 404/41, 37, 42; 52/315, 603, 604
See application file for complete search history.

(56) References Cited

U.S. PATENT DOCUMENTS

| | | | | |
|---|---|---|---|---|
| 2,919,634 | A * | 1/1960 | Plotner | 404/42 |
| 4,792,257 | A * | 12/1988 | Rinninger | 404/41 |
| 5,533,827 | A * | 7/1996 | Scheiwiller | 404/38 |
| 5,957,619 | A * | 9/1999 | Kinoshita et al. | 404/31 |
| 6,073,411 | A * | 6/2000 | Ciccarello | 52/589.1 |
| 6,168,347 | B1 * | 1/2001 | Milot et al. | 404/34 |
| 6,269,605 | B1 * | 8/2001 | Geiger | 52/608 |
| 6,536,988 | B2 * | 3/2003 | Geiger | 404/39 |
| 6,705,797 | B1 * | 3/2004 | Wada | 404/38 |
| 2001/0048849 | A1 * | 12/2001 | Rinninger | 404/41 |
| 2002/0104283 | A1 | 8/2002 | Geiger | |
| 2005/0066607 | A1 * | 3/2005 | Hagenah | 52/596 |

FOREIGN PATENT DOCUMENTS

| | | |
|---|---|---|
| DE | 297 19 069 U1 | 12/1997 |
| DE | 299 09 828 U1 | 9/1999 |
| DE | 203 17 542 U1 | 2/2004 |
| EP | 0 954 639 B1 | 11/1999 |
| WO | WO 99/54552 A1 | 10/1999 |

* cited by examiner

*Primary Examiner*—Thomas B Will
*Assistant Examiner*—Abigail A Risic
(74) *Attorney, Agent, or Firm*—Burr & Brown

(57) ABSTRACT

A set of paving stones is provided, including a plurality of different paving stones that each respectively have a polygonal base surface, side surfaces with ribs and a visible side, for paving surfaces with optionally different laying patterns.

11 Claims, 27 Drawing Sheets

BL1
VM6
P
P
P

SET OF PAVING STONES

CROSS REFERENCE TO RELATED APPLICATION

This application is a continuation of International Application No. PCT/EP2006/004403, filed May 11, 2006, and German Application No. 10 2005 023 565.4, filed May 18, 2005, German Application No. 10 2005 054 384.7, filed Nov. 15, 2005, and German Application No. 10 2005 061 711.5, filed Dec. 21, 2005, the entireties of which are incorporated herein by reference.

FIELD OF THE INVENTION

The invention relates to a set of paving stones.

BACKGROUND OF THE INVENTION

EP 0 954 639 B1 discloses a set of paving stones that respectively have a polygonal base surface, side surfaces with ribs and visible sides, for paving surfaces with optionally different laying patterns.

SUMMARY OF THE INVENTION

It is the object of the invention to develop a set of paving stones that offers a multiplicity of paving stone types that can be combined with one another and can optionally be combined with one another in different quantities, it being possible for each paving stone type to be effectively gripped by a person and handled without risk to health.

The inventive set of paving stones has paving stones of a first paving stone type with a square base surface having a basic grid with a basic grid width of 14 cm and a basic grid length of 14 cm, and comprises paving stones of at least two further paving stone types, the latter having rectangular base surfaces whose widths correspond to the basic grid width and thus to the width of the first paving stone type, the second paving stone type having a length that corresponds to an integral multiple (n) of one fifth of the basic grid length or the length of the first paving stone type, it being true for the multiple (n) that $n<5$, and the third paving stone type having a length that corresponds to an integral multiple (m) of one fifth of the basic grid length or the length of the first paving stone type, it being true for the multiple (m) that $m>5$.

Proceeding from a first paving stone type, such a set can be used to form a multiplicity of paving stone variants without reaching dimensions where the larger paving stone types would otherwise reach dimensions and weights that make manual laying work that highly loads or overloads the body. Furthermore, in the inventive set, excessively large differences in dimension between the individual stones are avoided without thereby restricting the number of possible laying variants. Specifically, excessively large differences in dimension impede expert laying, since the individual paving stone types place different requirements on the underlying ground, and have different effects, in particular when being set down, on the underlying ground such that the laying of a flat surface is rendered difficult. The core of the invention is therefore a set that, in conjunction with a small spectrum of dimensions and masses of the various paving stones, offers a multiplicity of laying variants and in so doing offers a compatibility of all possible paving stone types with regard to a systematic realization of a grid system.

According to the invention, there is provided, in particular, a set of paving stones that include a first paving stone type with a square base surface that is assigned a larger paving stone type and a smaller paving stone type. These dependences between the paving stone types permit a multiplicity of laying variants in conjunction with a low number of stone types.

The invention further provides to supplement the set to four to seven paving stone types, the additional paving stone types all having the same width as the first paving stone type, but fundamentally larger lengths than the first paving stone type. Here, the largest length of a paving stone type corresponds to twice the length of the first paving stone type, and the linear dimensions, lying between the longest paving stone type and the first paving stone type, of the further paving stone types correspond to integral multiples of one fifth part of the length of the first paving stone type. Consequently, the appearance of a paved service, laid with the aid of the set and having relatively few paving stone types can easily be approximated to a paved surface with paving stones of random dimensions since, given the slight differences in dimension between the individual paving stone types, it is no longer possible for people quickly to recognize paving stones of the same dimensions, and so the impression of random dimensions occurs.

The invention further provides to supplement the set by a left-hand and a right-hand special paving stone type, the special paving stone types respectively being assembled from a rectangle, with a grid width corresponding to the basic grid, and a parallelogram attached to the rectangle, and the parallelogram thereby having a tilt angle that is defined by a right-angled triangle whose first leg corresponds to the length of the first paving stone type, and whose second leg corresponds to one fifth of the length of the first paving stone type. Further laying variants are possible by means of such special paving stone types, without departing from the system of the division by five.

It is provided according to the invention to give the rectangle of the special paving stone type a length that corresponds to three times one fifth of the basic grid defined by the first paving stone type. When solely viewing the rectangular fraction of the special paving stone, this creates a further paving stone type, which corresponds to the system and has a length that is shorter than the second paving stone type by one fifth of the basic grid.

The invention also provides to furnish the parallelogram of the special paving stone type with a length that corresponds to the basic grid, and thereby to integrate said parallelogram in the system of division by five.

The invention further provides to calculate the number of the ribs arranged on the side surfaces of the paving stones from the side length of the paving stones using the following formula: (side length/2.8)−1. This uniform stipulation of the number of ribs ensures an error-free interaction of different paving stone types in all laying situations.

According to the invention, the square paving stone type (P1) is provided with dimensions of 10 cm×10 cm to 16 cm×16 cm. Proceeding from these dimensions, all paving stone types of the set have handy dimensions.

The invention provides, in particular, to give the square paving stone type (P1) dimensions of 14 cm×14 cm. In the case of such dimensions, a laying width of 0.5 m or a multiple of 0.5 m can be achieved with adequate accuracy for building purposes by a combination of different paving stone types of the set. Consequently, the set is suitable for laying standardized traffic areas.

The invention further provides to give the square paving stone type (P1) dimensions of 16 cm×16 cm. In the case of such dimensions, it is likewise possible to achieve a laying width of 0.5 m or a multiple of 0.5 m by a combination of different paving stone types of the set with adequate accuracy for building purposes. Consequently, the set is likewise suitable for laying standardized traffic areas. In addition, it is possible in the case of a paving stone type (P7) to achieve a length (L7) of 30 cm which enables a transition into an area, which is laid out with plates of size 30 cm×30 cm, while continuing the pattern of joints.

Furthermore, at least one of those paving stone types of the set that have greater length than the square stone P2 is provided on its underside by the invention with a groove aligned centrally transverse to the longitudinal direction thereof. Owing to the central arrangement of the groove, it is possible when laying the paving stones of the set, which avoids the formation of cross joints in the laying pattern, simultaneously to avoid a groove or a channel from being continued over a number of rows of stones. As a result, a flow of the infiltrating water below the laid stone surface is avoided, and the water infiltrates below the paving stone at whose edges it gathered. Consequently, the paving is also suitable for laying on sloping surfaces, since an undesired accumulation of water, caused by the configuration of the ground, at deeper lying points of the paving is avoided.

BRIEF DESCRIPTION OF THE DRAWINGS

Further details of the invention are described in the drawing with the aid of schematically illustrated exemplary embodiments.

DETAILED DESCRIPTION OF THE INVENTION

Figure 1:
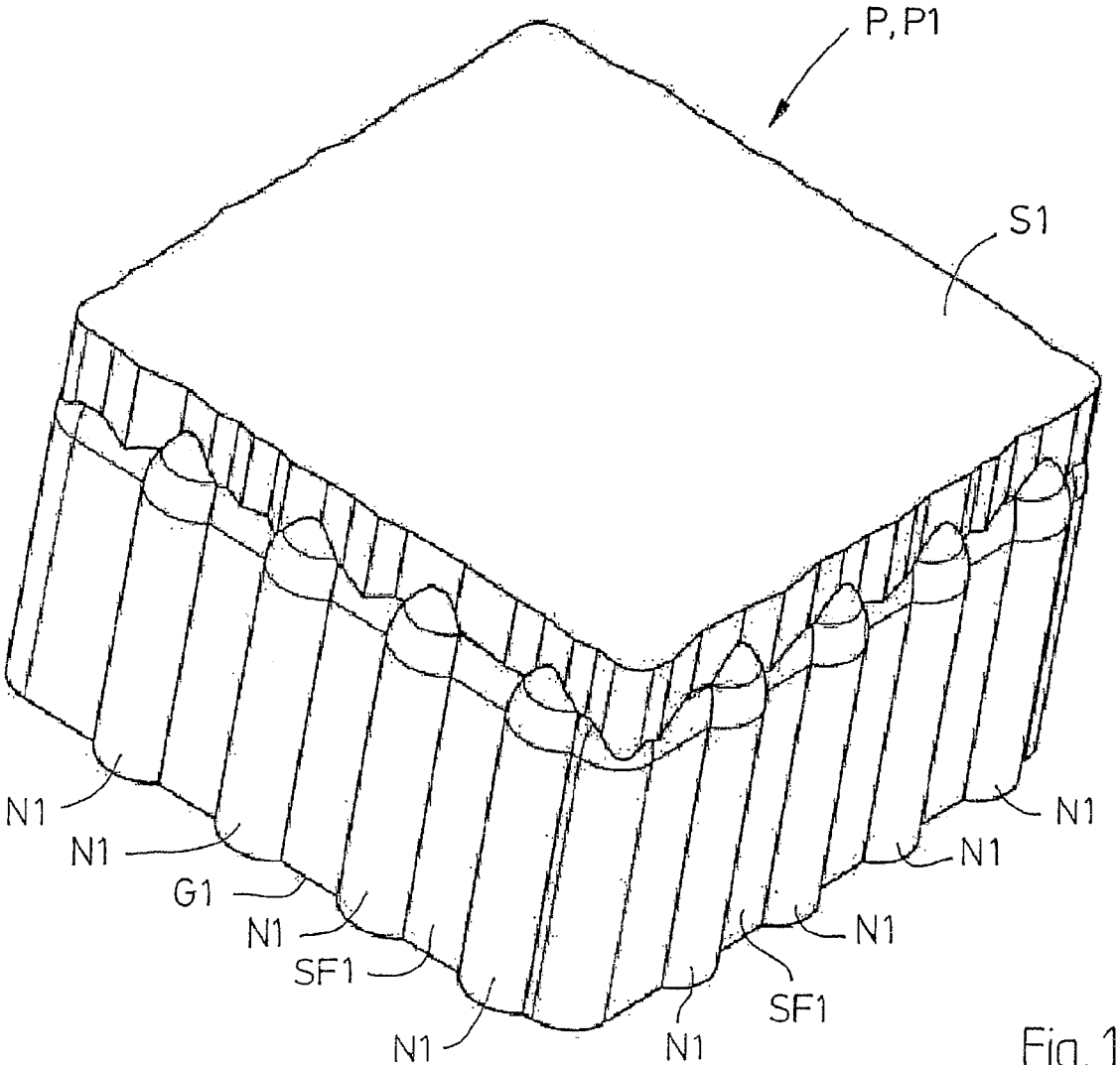
FIG. 1 shows a perspective view of a first paving stone type (P1).

FIG. 1 illustrates a paving stone P of a first paving stone type P1 in a perspective view. The paving stone type P1 has a substantially square base surface G1, four side surfaces SF1 and a visible side S1. Four ribs N1 are respectively arranged on the side surfaces SF1.

Figure 2:
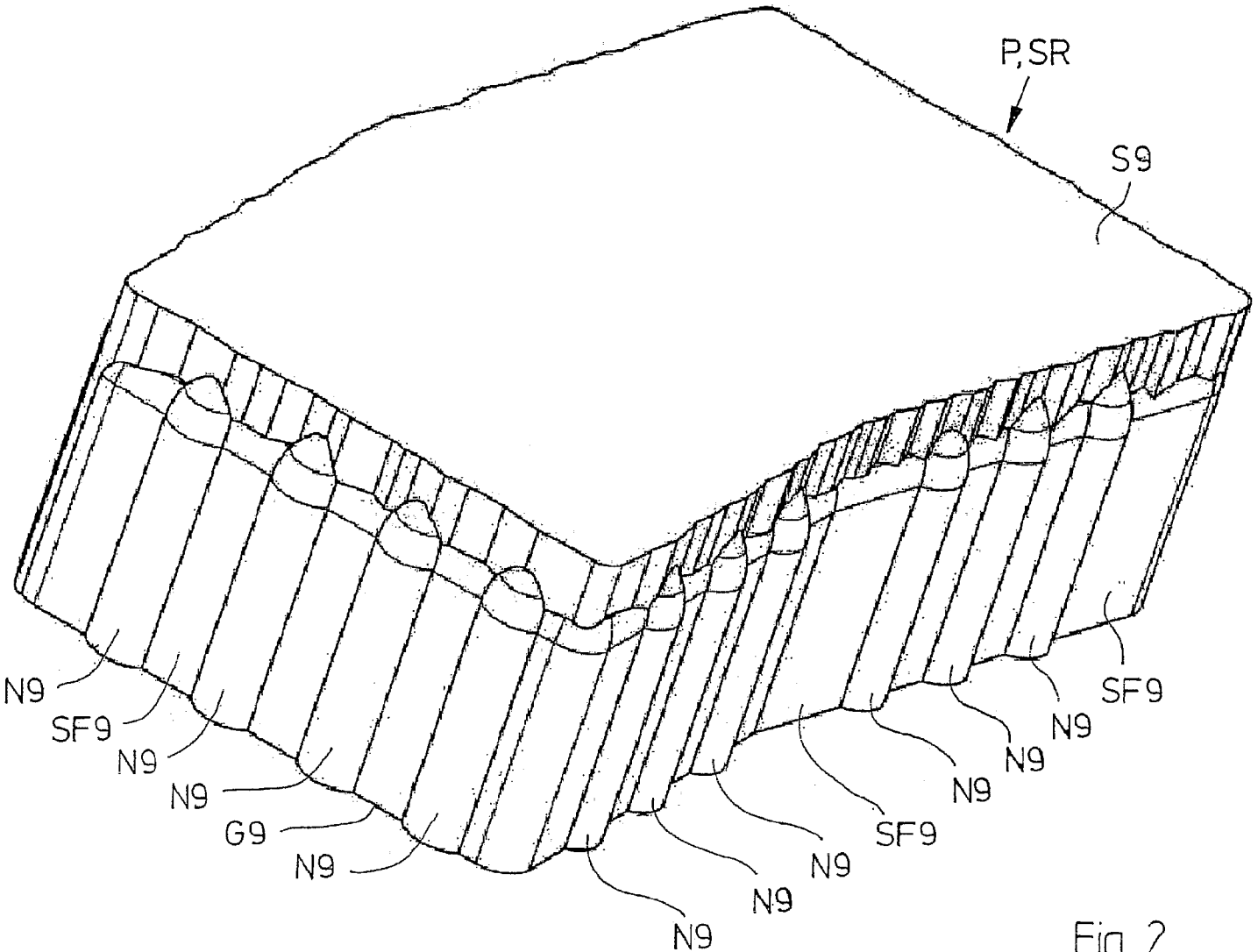
FIG. 2 shows a perspective view of a special stone type (SR) bent to the right.

FIG. 2 shows a paving stone P of a special paving stone type SR that has a polygonal base surface G9, six side surfaces SF9 and a visible side S9. Three or four ribs N9 are respectively arranged on the side surfaces S9.

Figure 3:
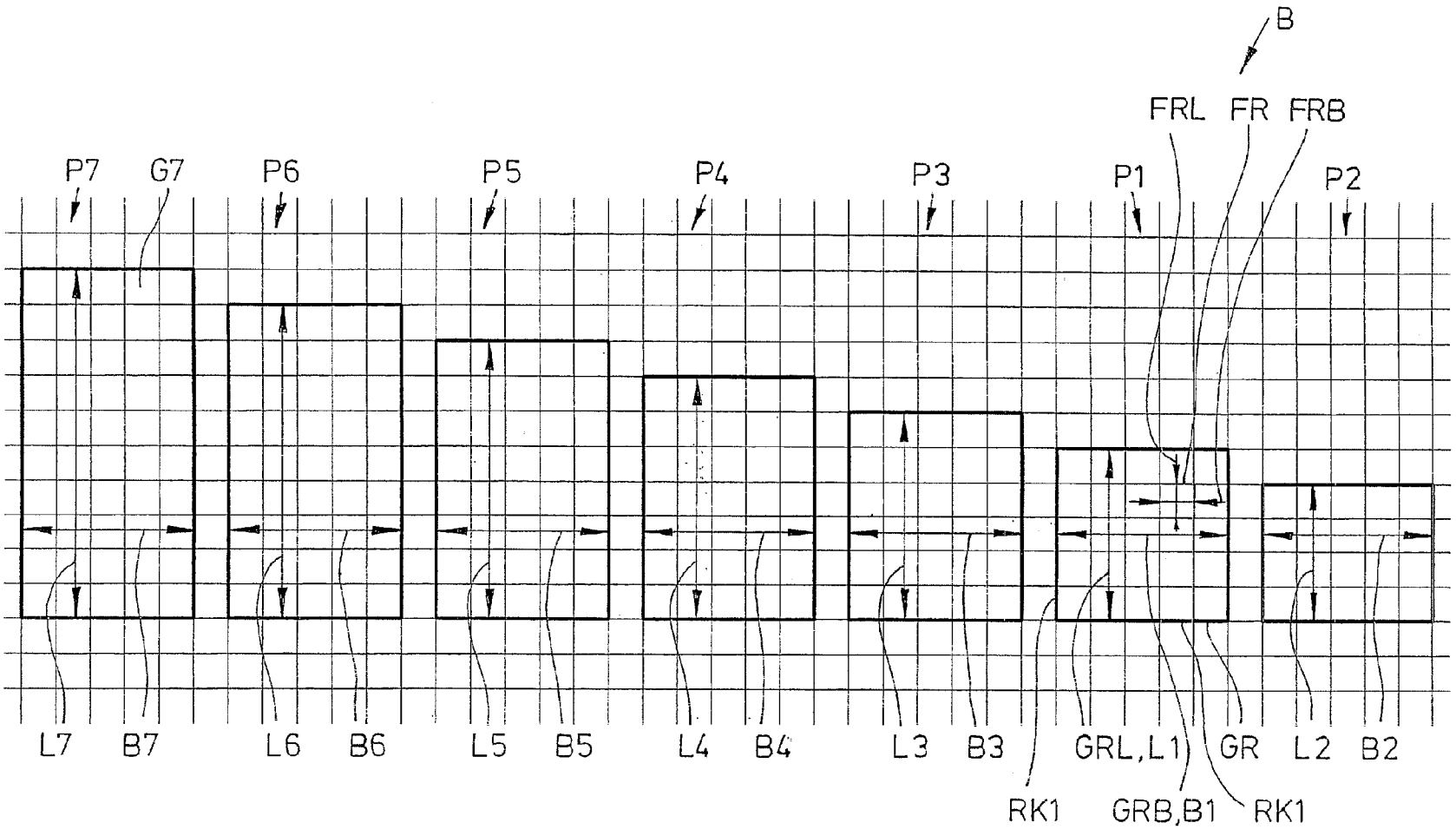
FIG. 3 shows a schematic illustration of seven paving stone types (P1-P7) through their grid lines.

FIG. 3 illustrates seven paving stone types P1 to P7 of a set B schematically. The paving stone type P1 defines with its grid edges RK1 a square basic grid GR with a basic grid width GRB that corresponds to a width B1=14 cm, and a basic grid length GRL that corresponds to a length L1=14 cm. This basic grid GR is subdivided into a square fine grid FR with a fine grid width FRB=2.8 cm and a fine grid length FRL=2.8 cm. The fine grid FR is produced from the basic grid GR by dividing the basic grid width GRB and the basic grid length GRL by a division factor t=5. The second paving stone type P2 has a width B2=B1=14 cm and a length L2=11.2 cm. By comparison with the first paving stone type P1, the length L2 of the paving stone type P2 is shortened by a fine grid length FRL. Its length L2 is defined by a multiple n of value 4 and is calculated using the formula L2=(L1/t)*n or L2=FRL*n.

The further paving stone types P3 to P7, of which only at least one need be represented in the inventive set B, all have lengths L3 to L7 that are greater than the length L1 of the paving stone type P1. Widths B3 to B7 of the paving stone types P3 to P7 correspond to the widths B1 and B2, respectively, of the paving stone types P1 and P2, respectively. The length L7 of the paving stone type P7 is calculated, for example, from the formula L7=(L1/t)*m, in which case m=10. Consequently, the paving stone type P7 has a base surface G7 that corresponds to twice the base surface G1 of the paving stone type P1.

Figure 4:
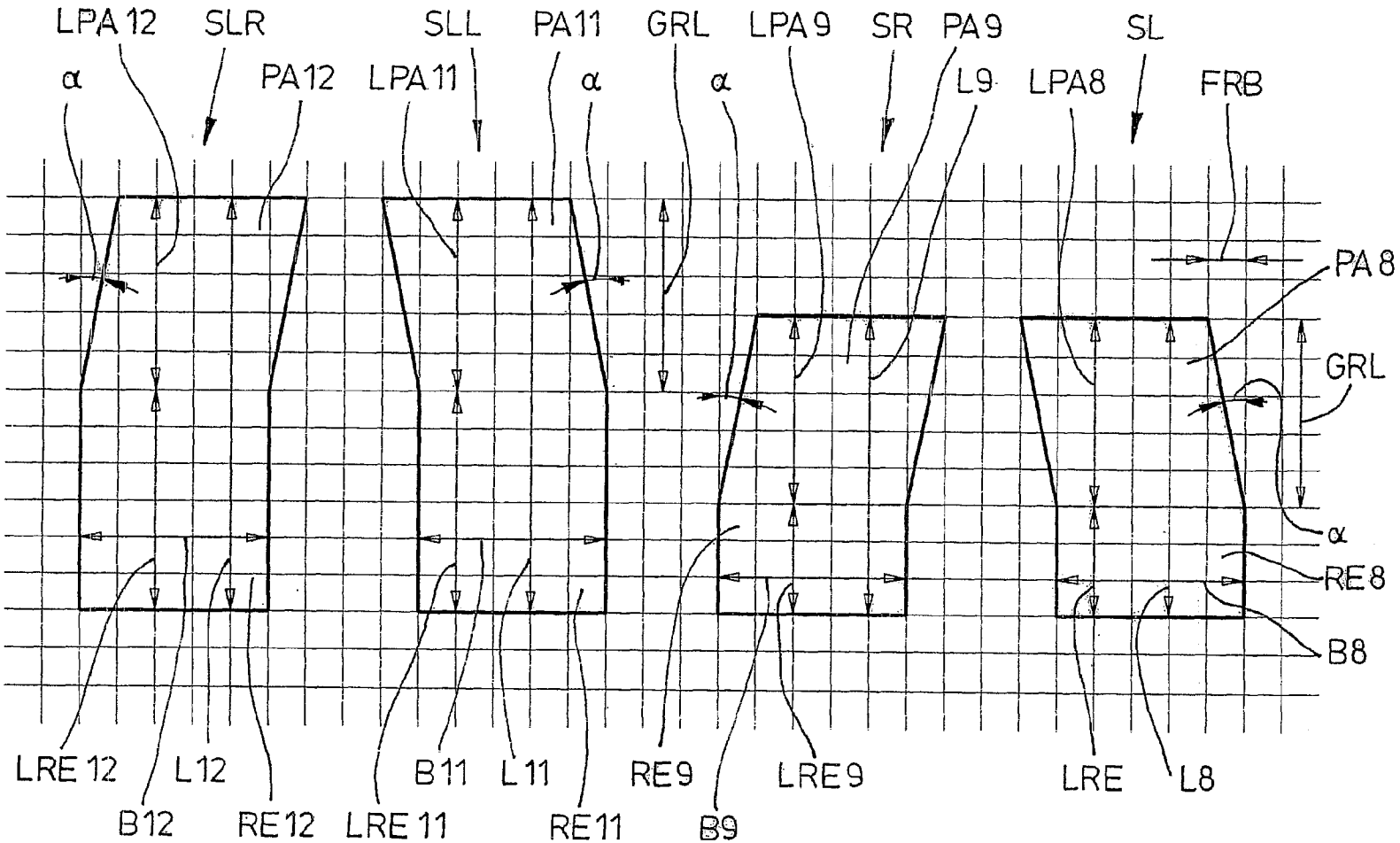
FIG. 4 shows a schematic illustration of four special paving stone types (SR, SL, SLR, SLL) through their grid lines.

FIG. 4 now shows the special stone type SR of FIG. 2, and three further special stone types SL, SLR and SLL in a schematic illustration corresponding to the illustrations in FIG. 3. In the plan view, the special paving stone types SL and SR are respectively assembled from a rectangle RE8 or RE9, and a parallelogram PA8 or PA9. Here, the rectangles RE8 and RE9 respectively have widths B8 and B9 that correspond to the width B1 of the paving stone type P1 (see also FIG. 3). Respective lengths LRE8 and LRE9 of the rectangular fractions RE8 and RE9 of the special stones SL and SR are calculated using the formula LRE8=LRE9=(GRL/t)*p, p preferably assuming the value 3. Respective lengths LPA8 and LPA9 of the parallelograms PA8 and PA9 are calculated using the formula LPA8=LPA9=(GRL/t)*q, q preferably assuming the value 5. Here, the parallelogram PA8 or PA9 has a tilt angle $\alpha$ that is defined by an offset of a fine grid width FRB on a basic grid length GRL. The tilt angle $\alpha$ is approximately 10°.

In plan view, the special paving stone types SLL and SLR are respectively assembled from a rectangle RE11 or RE12 and a parallelogram PA11 or PA12. Here, the rectangles RE11 and RE12 respectively have widths B11 and B12 that correspond to the width B1 of the paving stone type P1 (see also FIG. 3). Respective lengths LRE11 and LRE12 of the rectangular fractions RE11 and RE12 of the special stones SLL and SLR are calculated using the formula LRE11=LRE12=(GRL/t)*p, p preferably assuming the value 6. Respective lengths LPA11 and LPA12 of the parallelograms PA11 and PA12 are calculated using the formula LPA11=LPA12=(GRL/t)*q, q preferably assuming the value 5. Here, the parallelogram PA11 or PA12 has a tilt angle $\alpha$ that is defined by an offset of a fine grid width FRB on a basic grid length GRL. The tilt angle $\alpha$ is approximately 10°.

Figure 5:
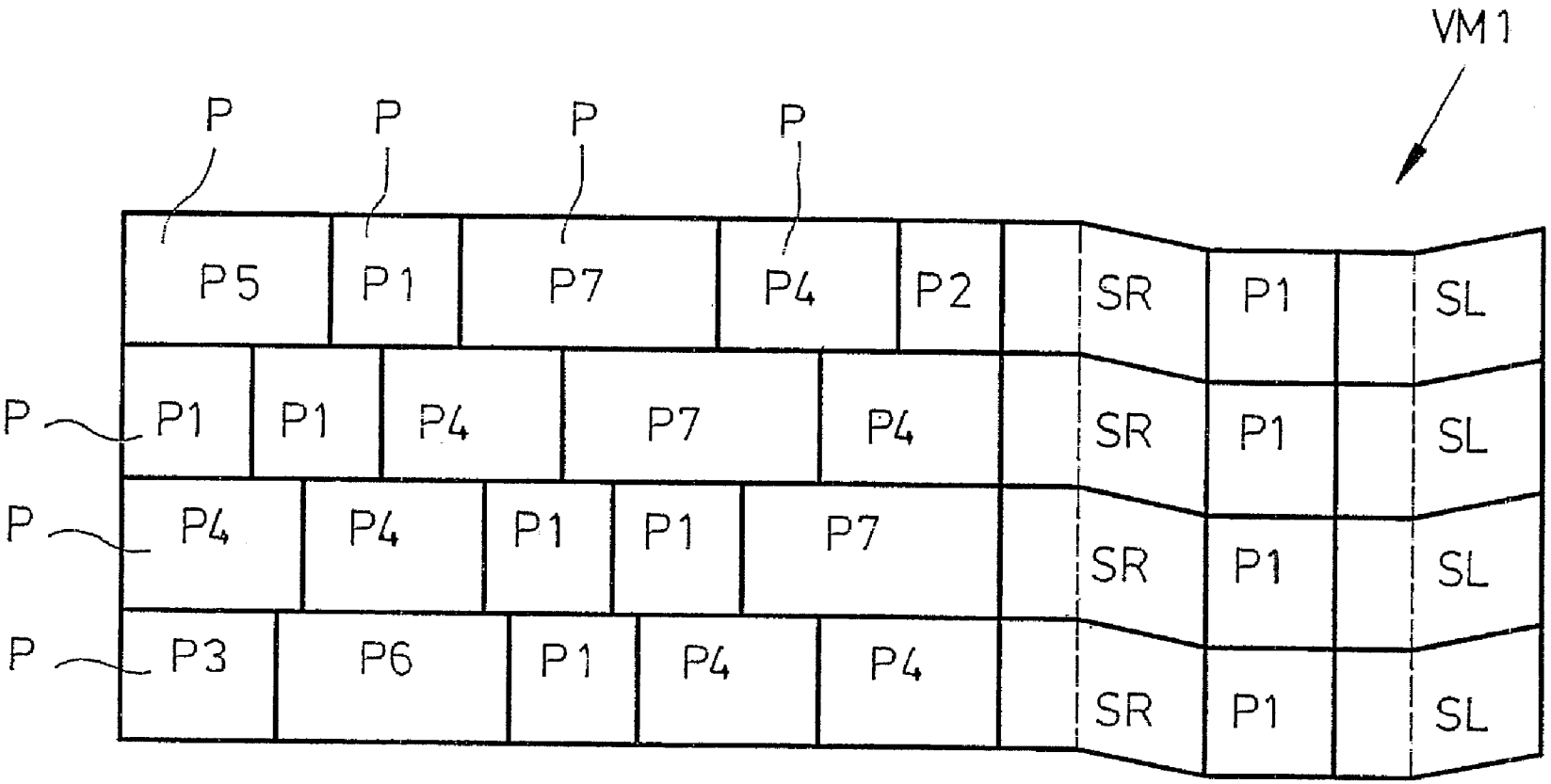
FIG. 5 shows a schematic illustration of a first laying pattern.
Figure 6:
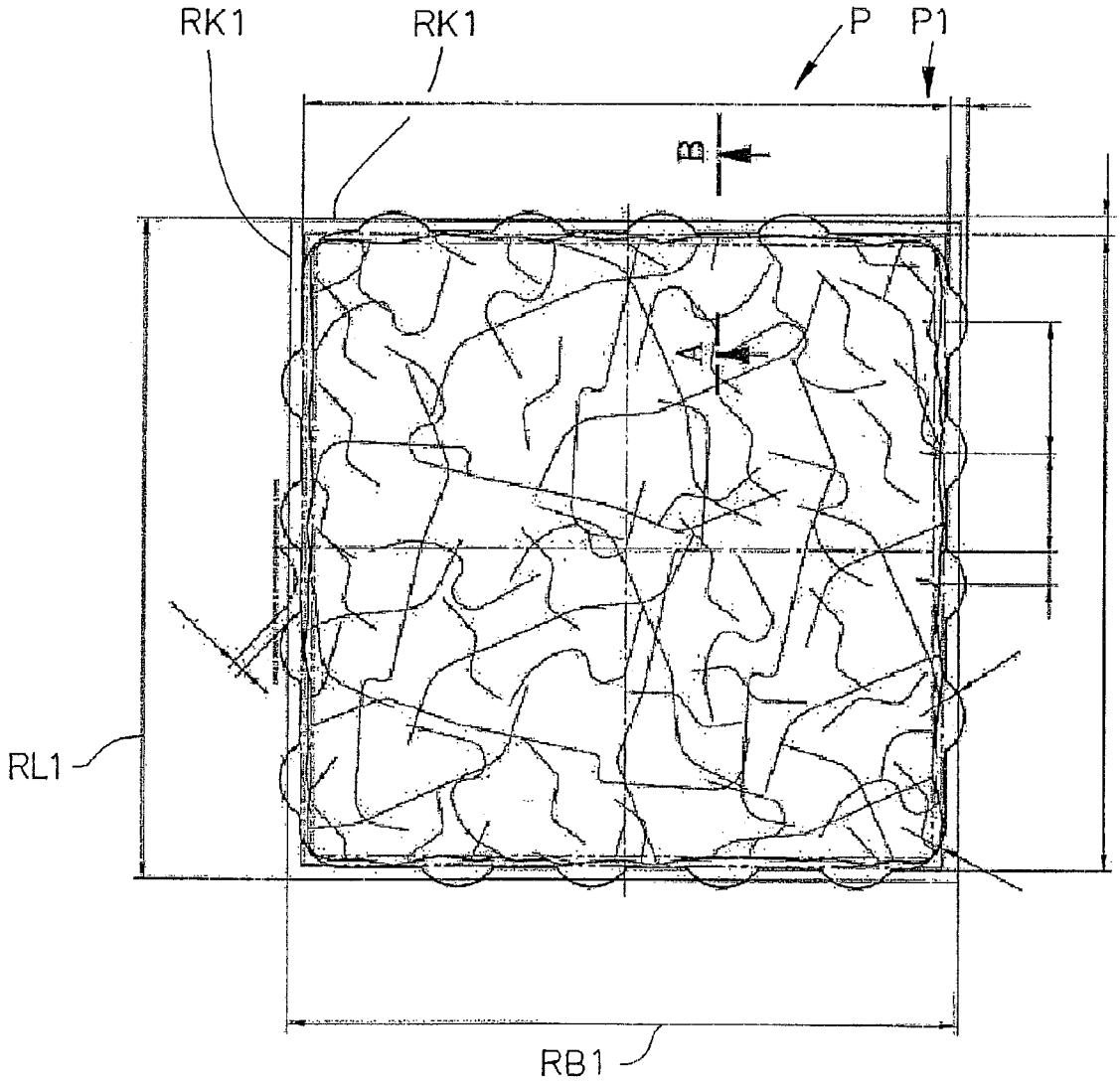
FIGS. 6-12 show plan views of paving stone types P1 to P7.
Figure 7:
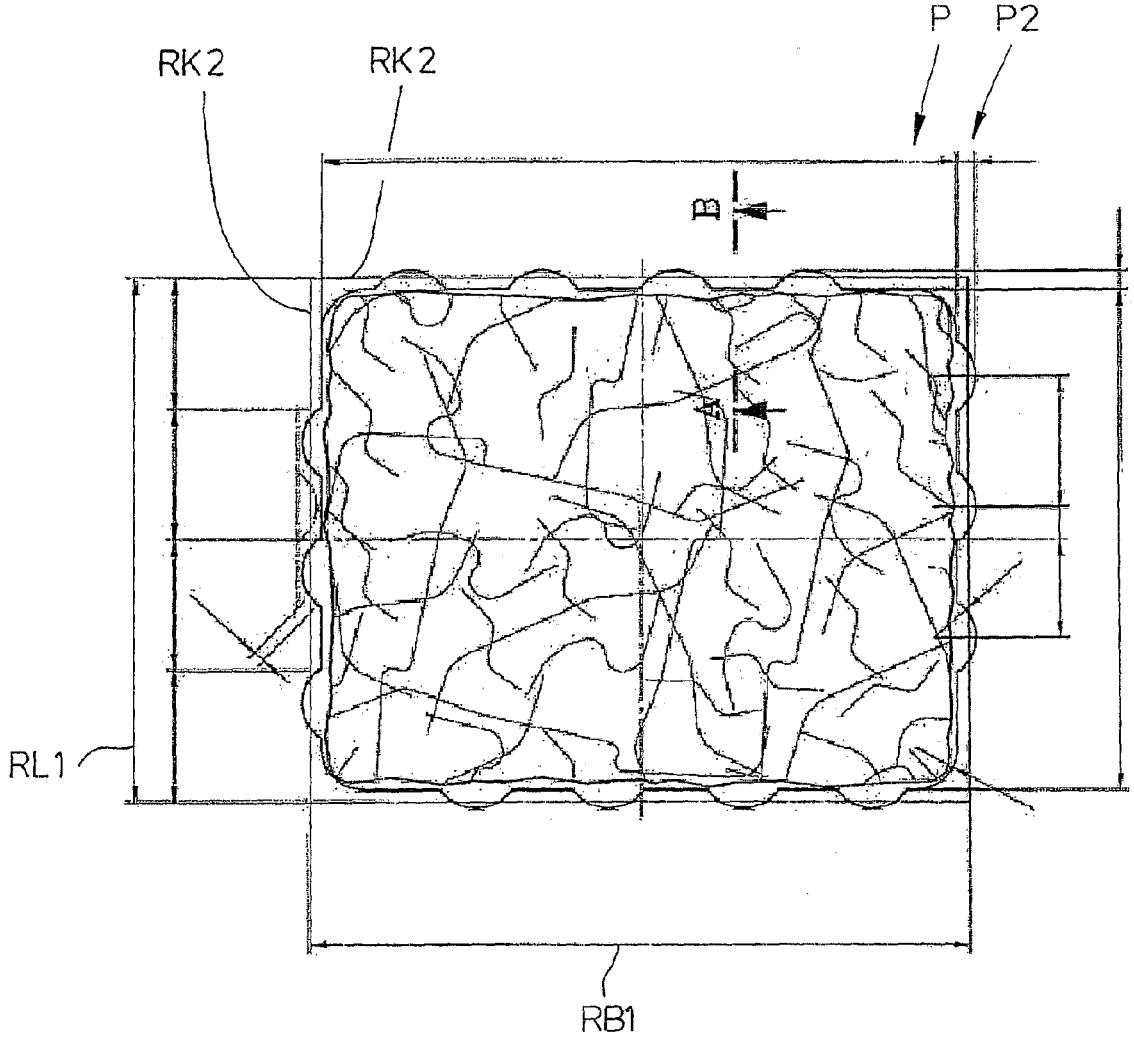
Figure 8:
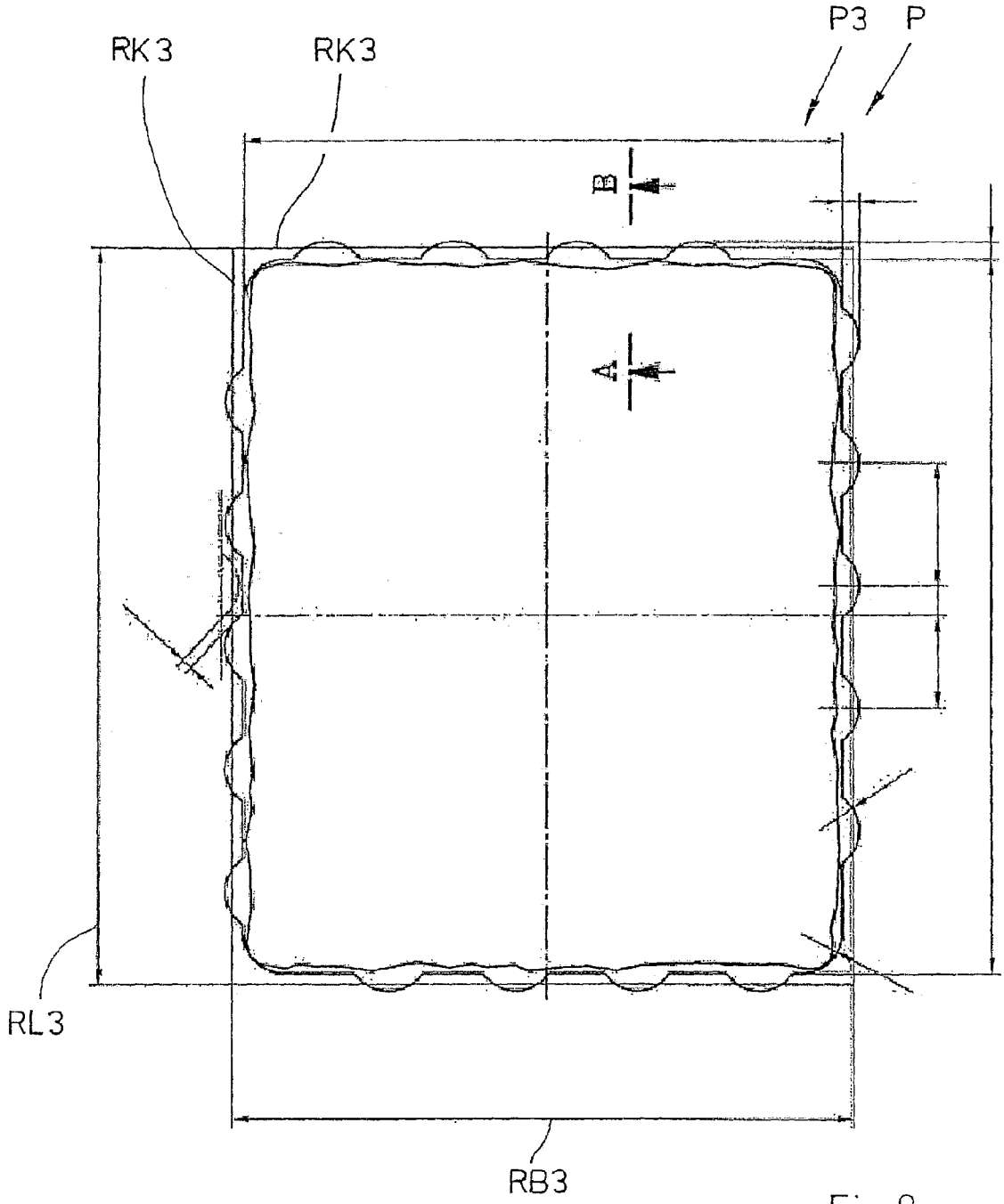
Figure 9:
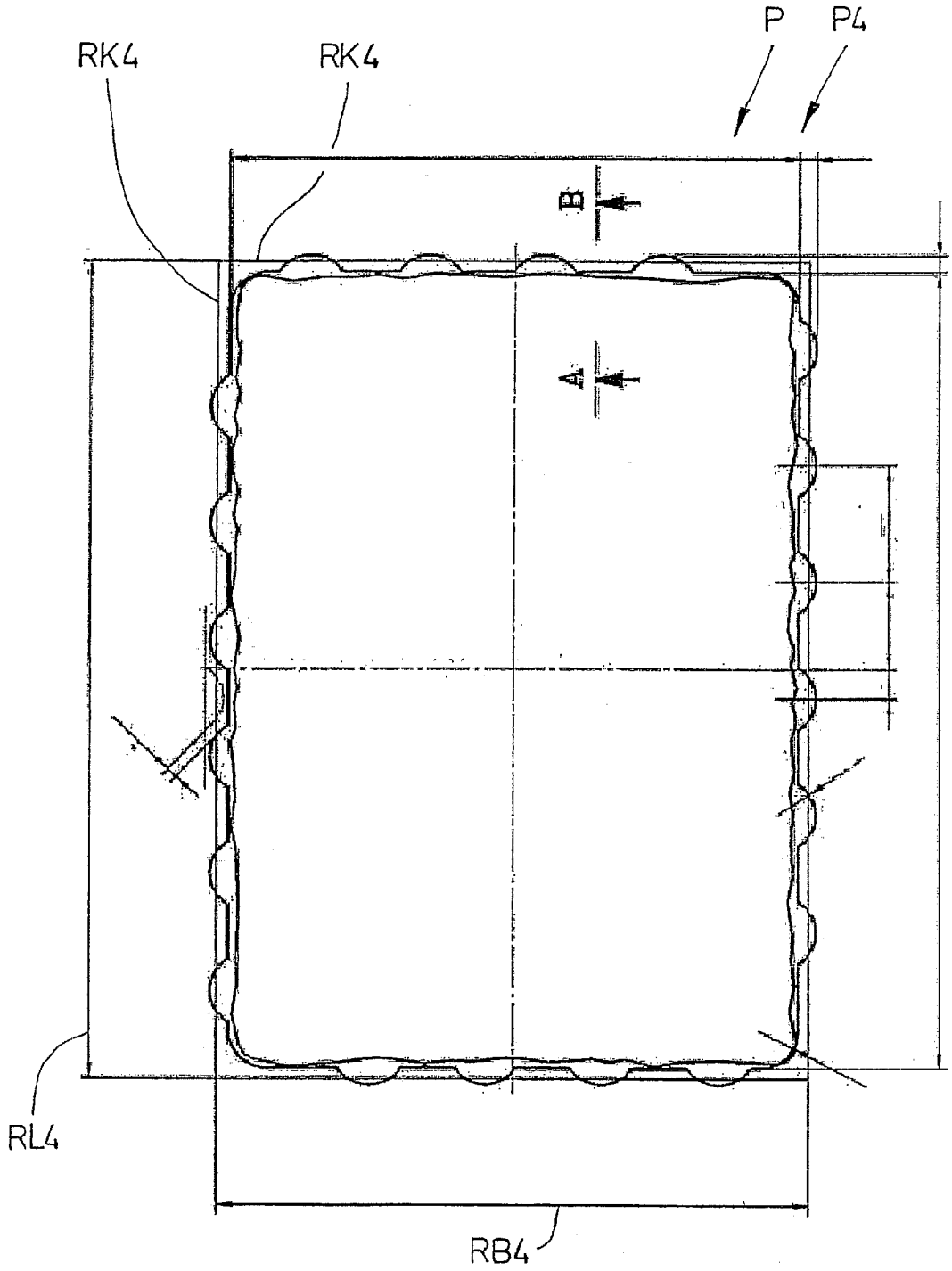
Figure 10:
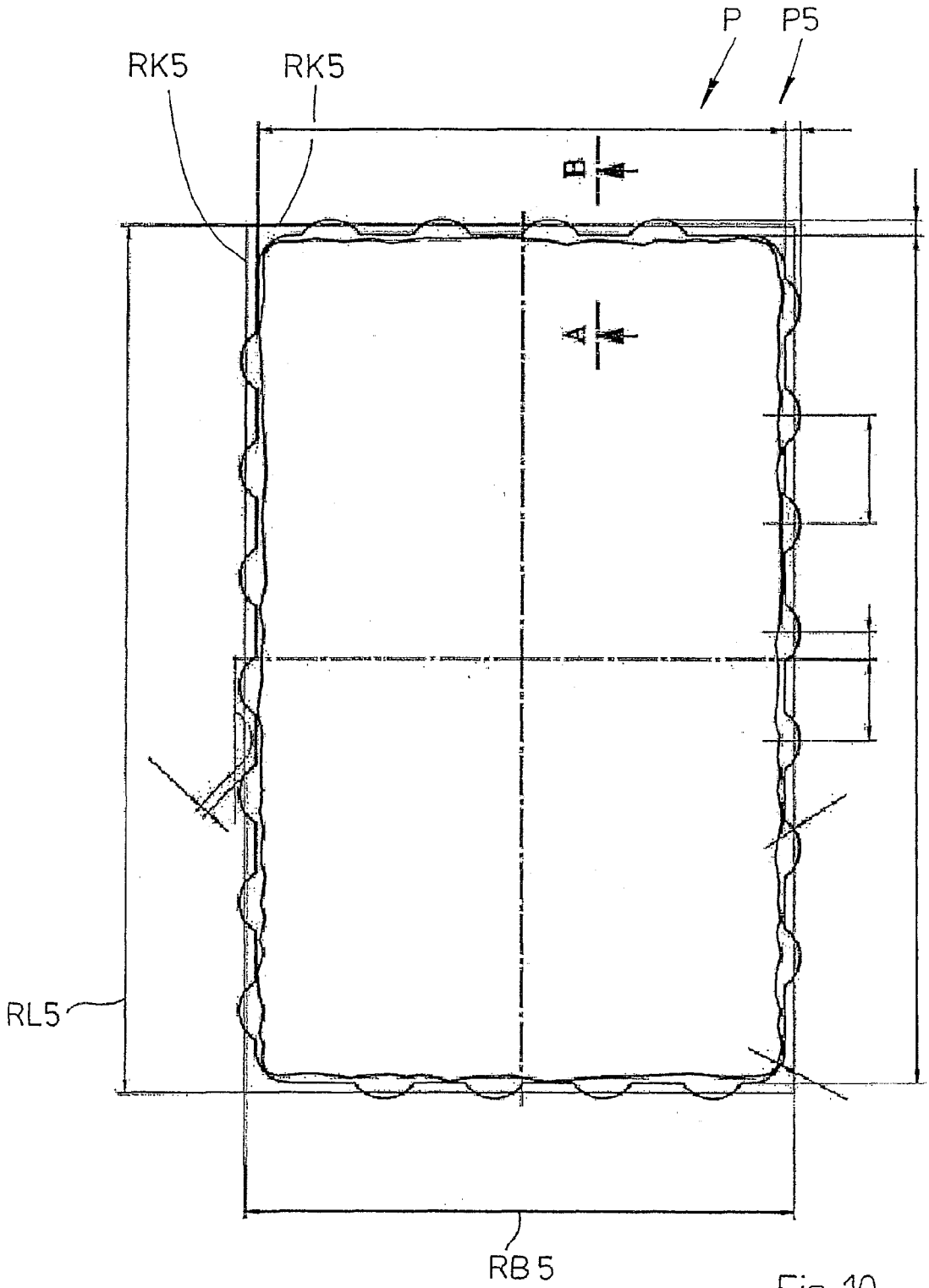
Figure 11:
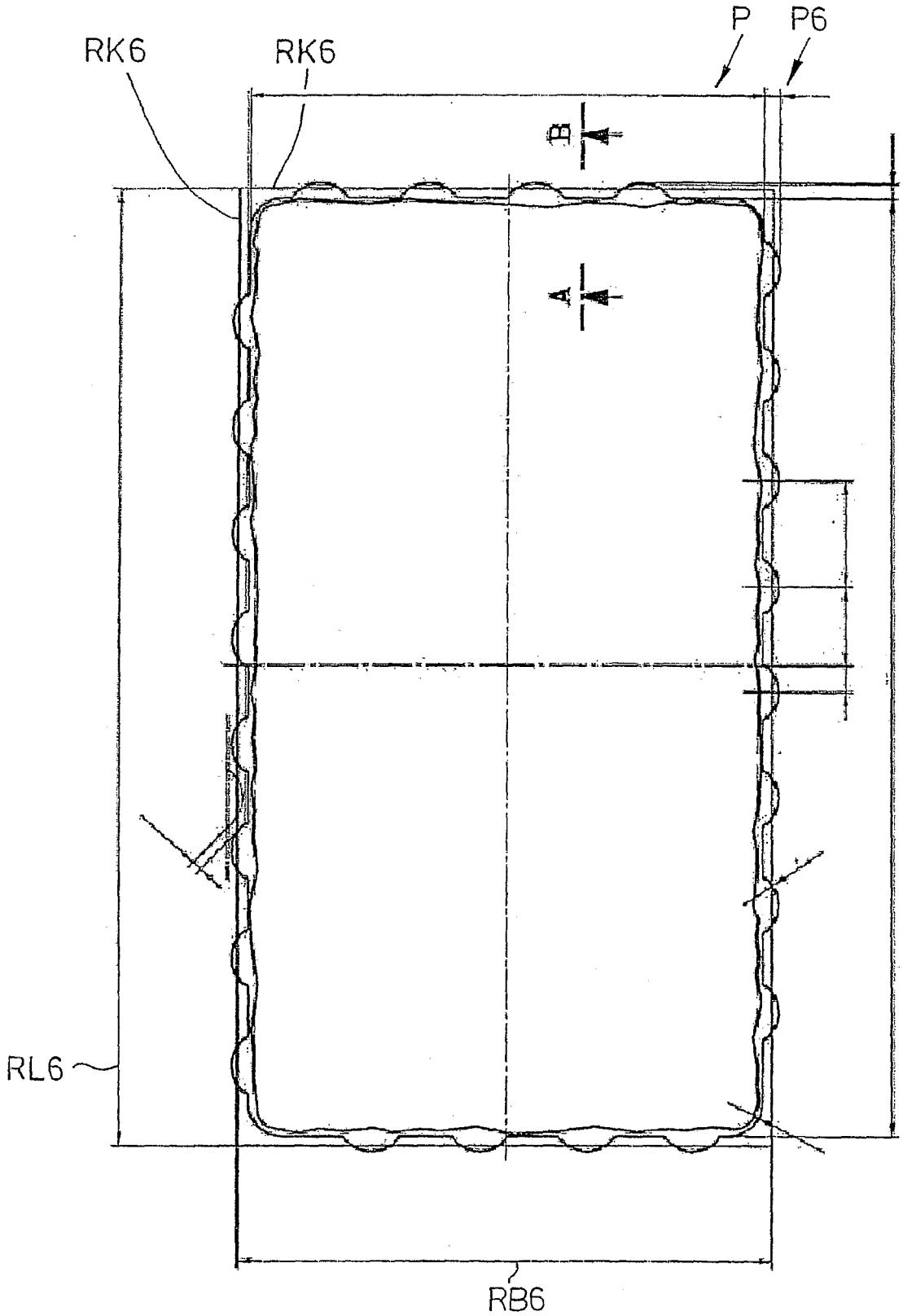
Figure 12:
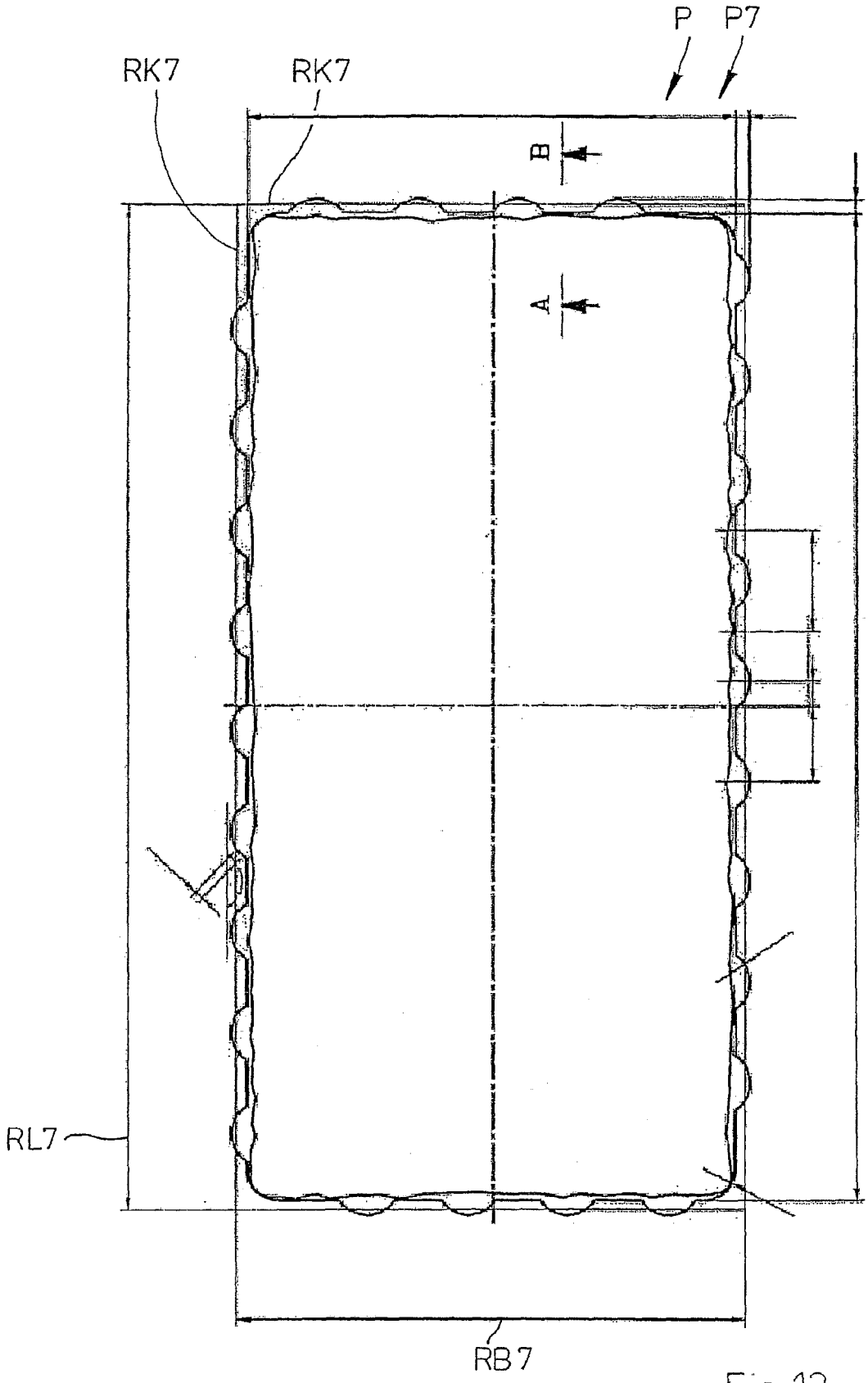

FIG. 5 illustrates a first laying pattern VM1 in plan view, the individual paving stones P being illustrated schematically by their respective grid edges. The laying pattern VM1 is assembled from paving stones P of the paving stone types P1 to P7, SL and SR.

FIGS. 6 to 12 illustrate paving stones P of the paving stone types P1 to P7 in plan view. The grid edges RK1 to RK7 define the paving stones P as regards their main dimensions B1 to B7 or L1 to L7, the grid edges RK1 to RK7 being imaginary edges that cut ribs N1 to N7 and define the area that is occupied by the individual paving stone P in a laid surface. Important parameters of the paving stone types P1 to P7 are summarized in the following table. The designation of longitudinal grid factor LRF is to be understood as a generic term for the factors n and m. The transverse grid factor QRF specifies by which factor the fine grid width FRB is to be multiplied in order to determine the width B1-B7 of the respective paving stone type P1-P7.

| | Paving stone type | | | | | | |
|---|---|---|---|---|---|---|---|
| | P2 | P1 | P3 | P4 | P5 | P6 | P7 |
| Length L1-L7 in cm | 12 | 15 | 18 | 21 | 24 | 27 | 30 |
| Longitudinal grid factor (LRF) | 4 | 5 | 6 | 7 | 8 | 9 | 10 |
| Number of ribs on the longitudinal side (NZL) | 3 | 4 | 5 | 6 | 7 | 8 | 9 |
| Width B1-B7 in cm | 15 | 15 | 15 | 15 | 15 | 15 | 15 |
| Transverse grid factor (QRF) | 5 | 5 | 5 | 5 | 5 | 5 | 5 |
| Number of ribs on the transverse side (NZQ) | 4 | 4 | 4 | 4 | 4 | 4 | 4 |
| Total number of ribs on the circumference | 14 | 16 | 18 | 20 | 22 | 24 | 26 |

In the case of such a set, laying widths that lie in the range of a multiple of 0.5 m can be achieved by a multiplicity of combinations. For example, a laying width of 50.4 cm can be implemented by the combination of following stone types:

$P2+P3+P5=11.2\text{ cm}+16.8\text{ cm}+22.4\text{ cm}=50.4\text{ cm}$ $P6+P1+P2=25.2\text{ cm}+14\text{ cm}+11.2\text{ cm}=50.4\text{ cm}$ $P1+P3+P4=14\text{ cm}+16.8\text{ cm}+19.6\text{ cm}=50.4\text{ cm}$ $P7+P2+P2=28\text{ cm}+11.2\text{ cm}+11.2\text{ cm}=50.4\text{ cm}$ $P6+P6=25.2\text{ cm}+25.2\text{ cm}=50.4\text{ cm}$ $P7+P5=28\text{ cm}+22.4\text{ cm}=50.4\text{ cm}$ It would be possible to realize a laying width of 100.8 cm, for example, by a twofold combination of said stone types.

In the entire text of the application, the length and width data L1-L10 and B1-B10, respectively, relate to the dimensions of the grid edges RK1-RK10 of the individual paving stones.

The above-described set can be extended with special stone types SL, SR, SLL and SLR in accordance with the illustrations in FIGS. 5, 16 to 19 and 22. The special stone types have the following dimensions, for example, to this end.

| | Special stone type | | | |
|---|---|---|---|---|
| | SL | SR | SLL | SLR |
| Index number | 8 | 9 | 11 | 12 |
| Width B in cm | 14 | 14 | 14 | 14 |
| Lengths LRE of the rectangular fractions RE in cm | 8.4 | 8.4 | 16.8 | 16.8 |
| Lengths LPA of the parallelogram fractions PA in cm | 14 | 14 | 14 | 14 |
| Lengths L of the special stone types | 22.4 | 22.4 | 30.8 | 30.8 |

Provided as an alternative to the above-described set, which is based on a paving stone P1 with L1=14 cm and B1=14 cm is a further set that is based on a paving stone P1 with L1=15 cm and L2=15 cm. The dimensions compiled in the following table then result for such a set.

| | Paving stone type | | | | | | |
|---|---|---|---|---|---|---|---|
| | P2 | P1 | P3 | P4 | P5 | P6 | P7 |
| Length L1-L7 in cm | 11.2 | 14 | 16.8 | 19.6 | 22.4 | 25.2 | 28 |
| Longitudinal grid factor (LRF) | 4 | 5 | 6 | 7 | 8 | 9 | 10 |
| Number of ribs on the longitudinal side (NZL) | 3 | 4 | 5 | 6 | 7 | 8 | 9 |
| Width B1-B7 in cm | 14 | 14 | 14 | 14 | 14 | 14 | 14 |
| Transverse grid factor (QRF) | 5 | 5 | 5 | 5 | 5 | 5 | 5 |
| Number of ribs on the transverse side (NZQ) | 4 | 4 | 4 | 4 | 4 | 4 | 4 |
| Total number of ribs on the circumference | 14 | 16 | 18 | 20 | 22 | 24 | 26 |

It is also possible by means of such a set to achieve laying widths that lie in the range of a multiple of 0.5 m, doing so with a multiplicity of combinations. For example, a laying width of 48 cm can be realized by the combination of following stone types:

$P2+P1+P4=12\text{ cm}+15\text{ cm}+21\text{ cm}=48\text{ cm}$ $P3+P3+P1=18\text{ cm}+18\text{ cm}+12\text{ cm}=48\text{ cm}$ $P5+P5=24\text{ cm}+24\text{ cm}=48\text{ cm}$ $P6+P4=27\text{ cm}+21\text{ cm}=48\text{ cm}$ $P7+P3=30\text{ cm}+18\text{ cm}=48\text{ cm}$ $P5+P1+P1=24\text{ cm}+12\text{ cm}+12\text{ cm}=48\text{ cm}$ It would be possible to realize a laying width of 96 cm, for example, by a twofold combination of said stone types.

Figure 13:
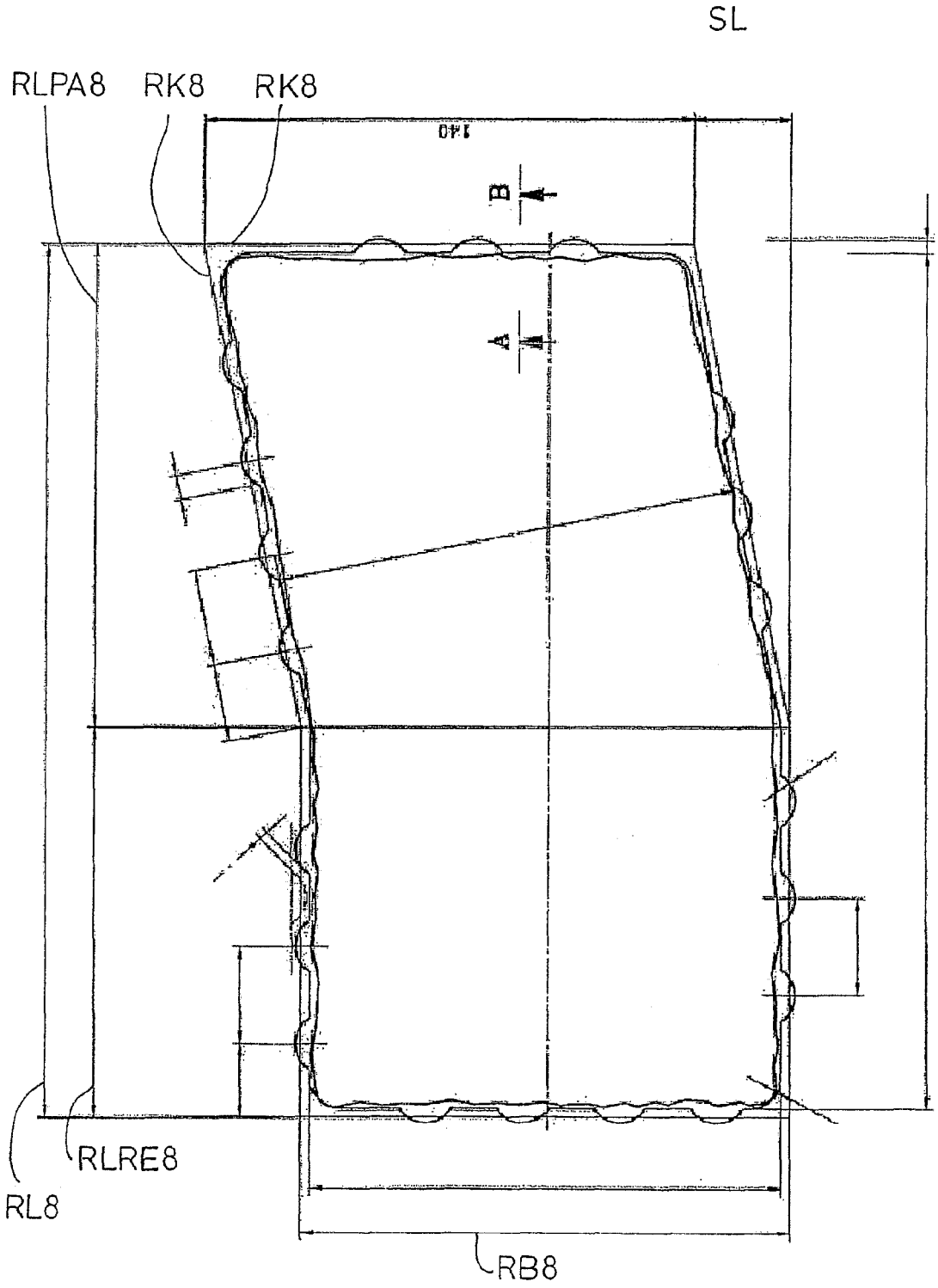
FIGS. 13 and 14 show plan views of special paving stone types SL and SR.
Figure 14:
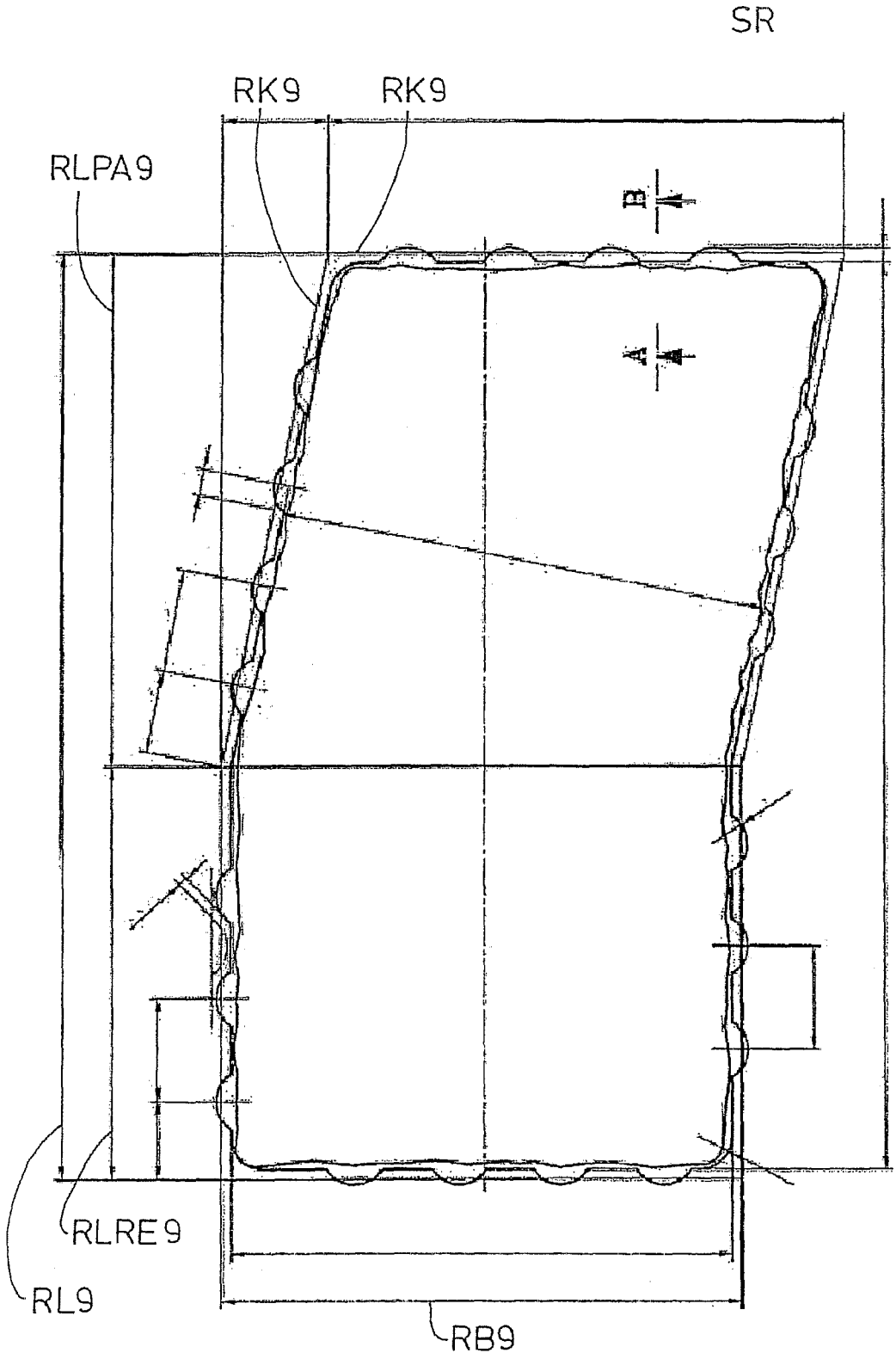

Paving stones P of paving stone types SL and SR are illustrated in plan view in FIGS. 13 and 14.

Figure 15:
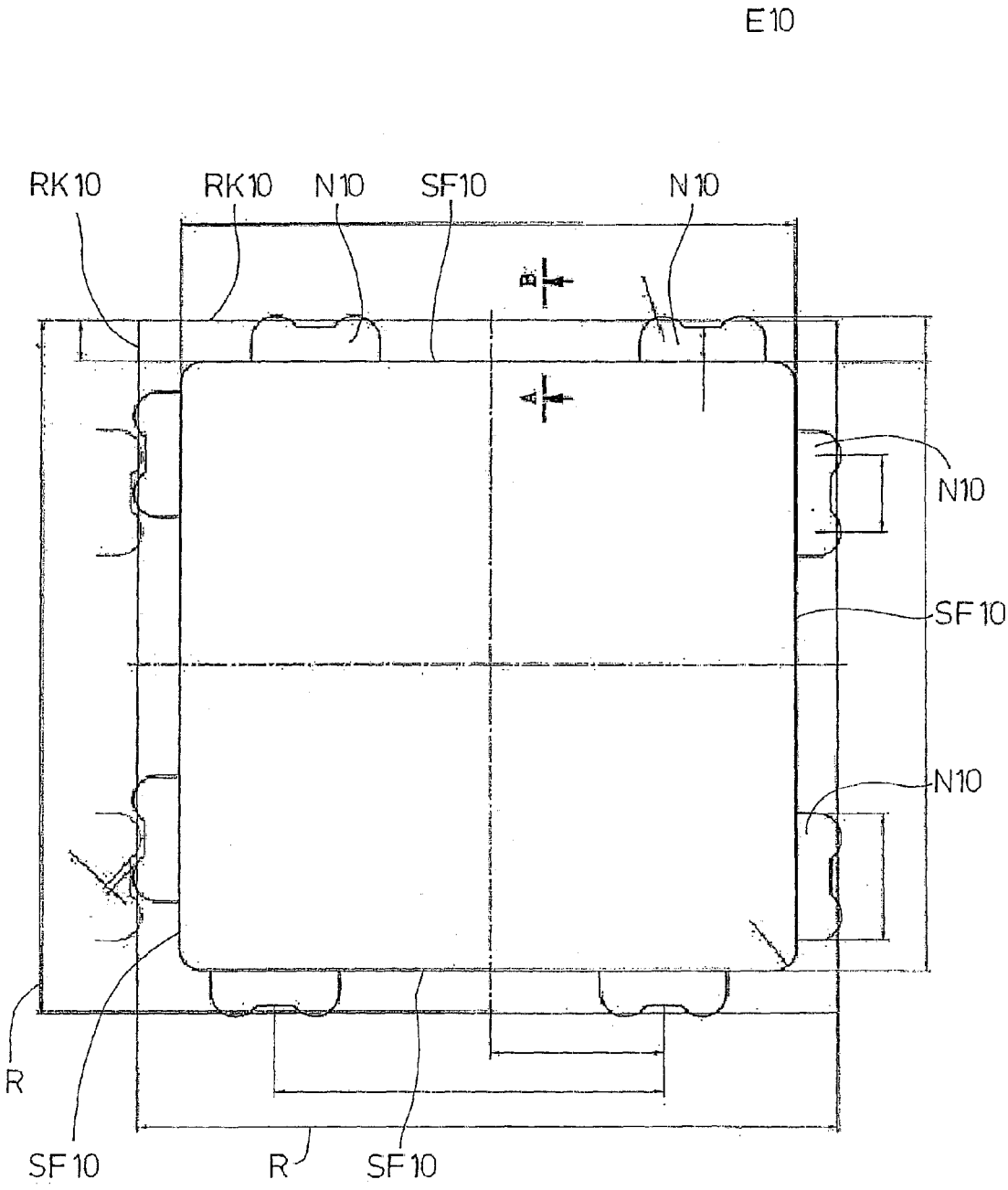
FIG. 15 shows a plan view of an eco-stone type E10, designed analogously to the paving stone type P1.

Finally, FIG. 15 shows a paving stone P of a lawn stone type E10 that corresponds in principle to the paving stone type P1. As distinguished from the paving stone type P1, side surfaces SF10 of the lawn stone type E10 are set back from grid edges RK10 of width B10 and length L10, which correspond to the grid edges RK1 or the width B1 and length L1 of the paving stone type 1 (see FIG. 6). Consequently, ribs N10 are embodied in a fashion correspondingly enlarged by comparison with ribs N1 of the paving stone type 1.

Figure 16:
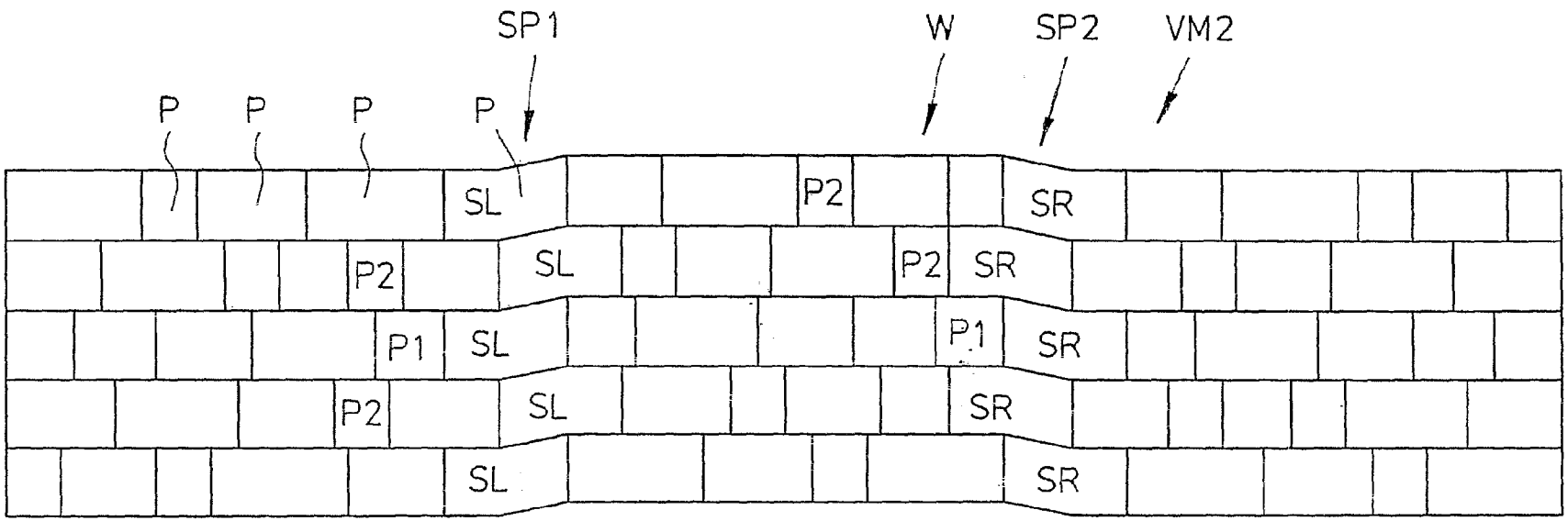
FIGS. 16-21 show schematic illustrations of further laying patterns.
Figure 17:
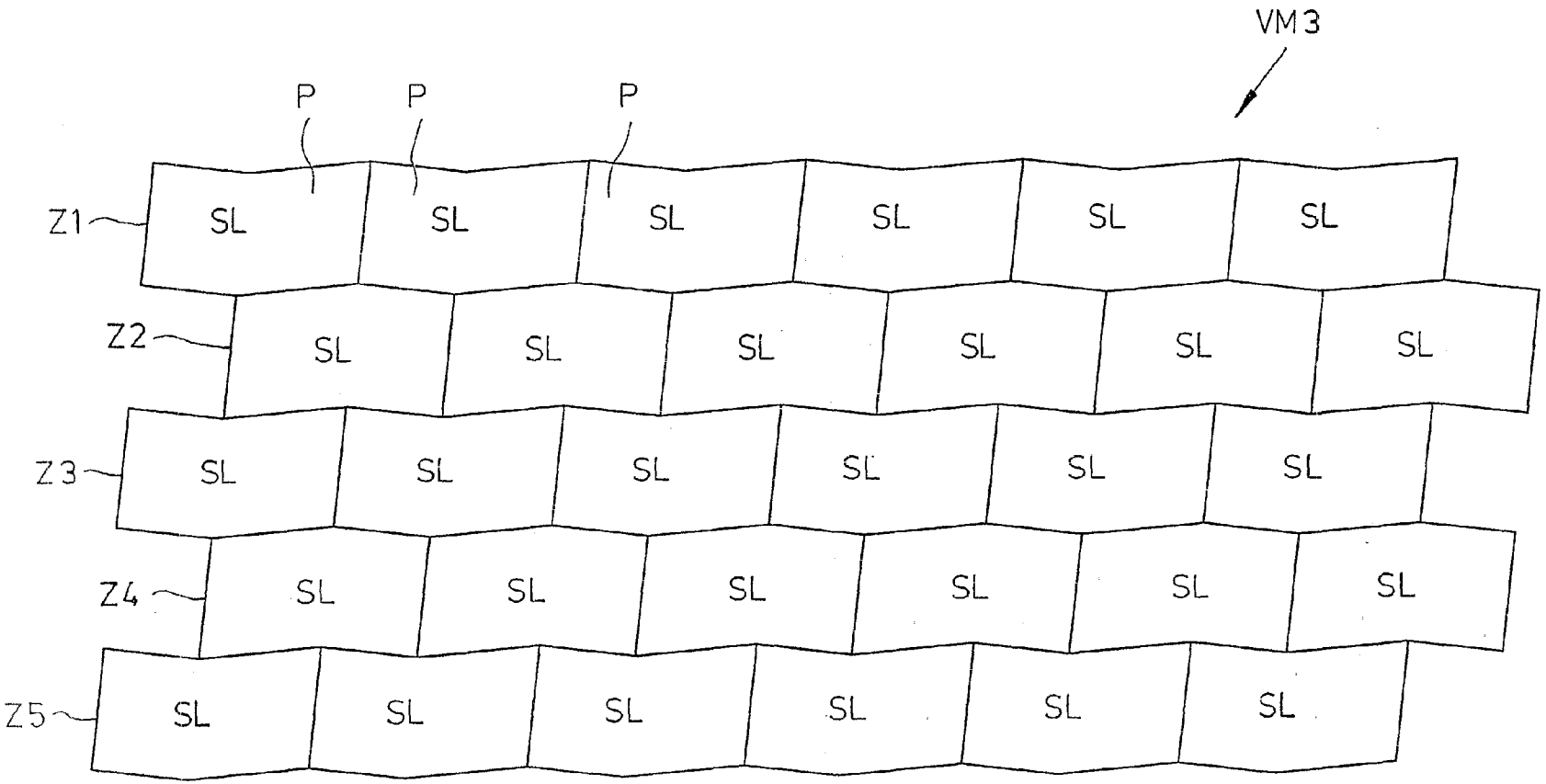
Figure 18:
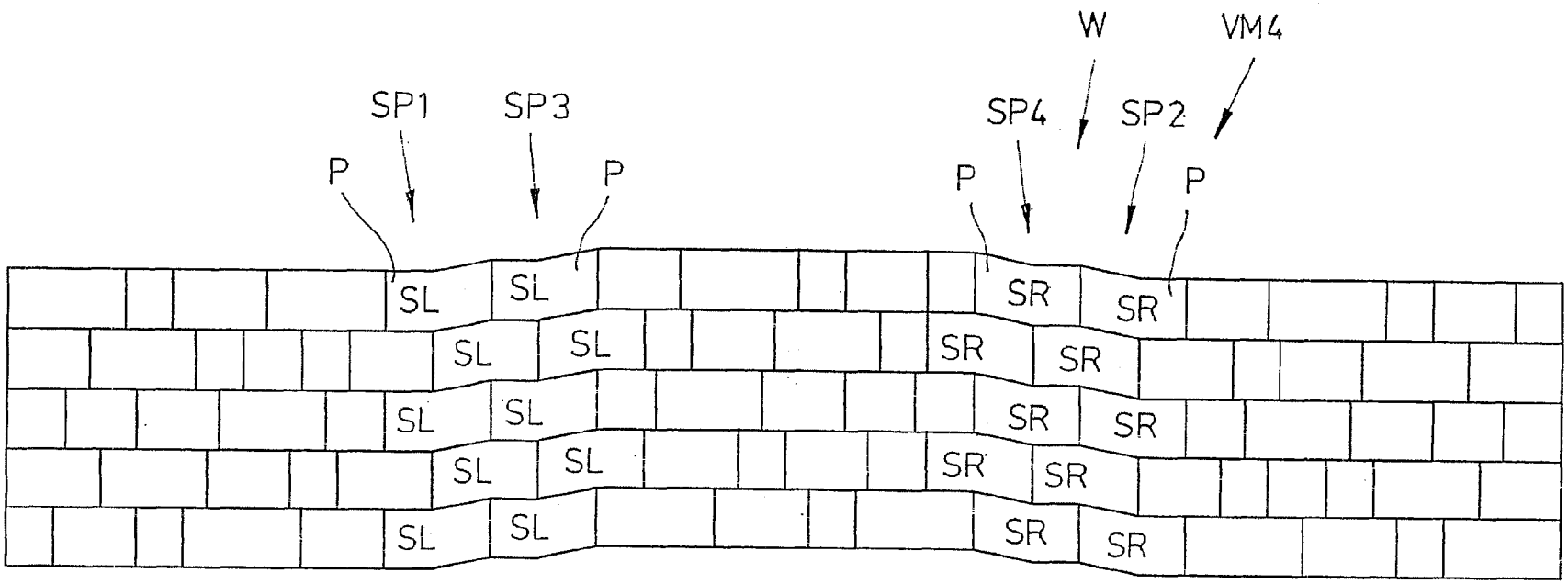
Figure 19:
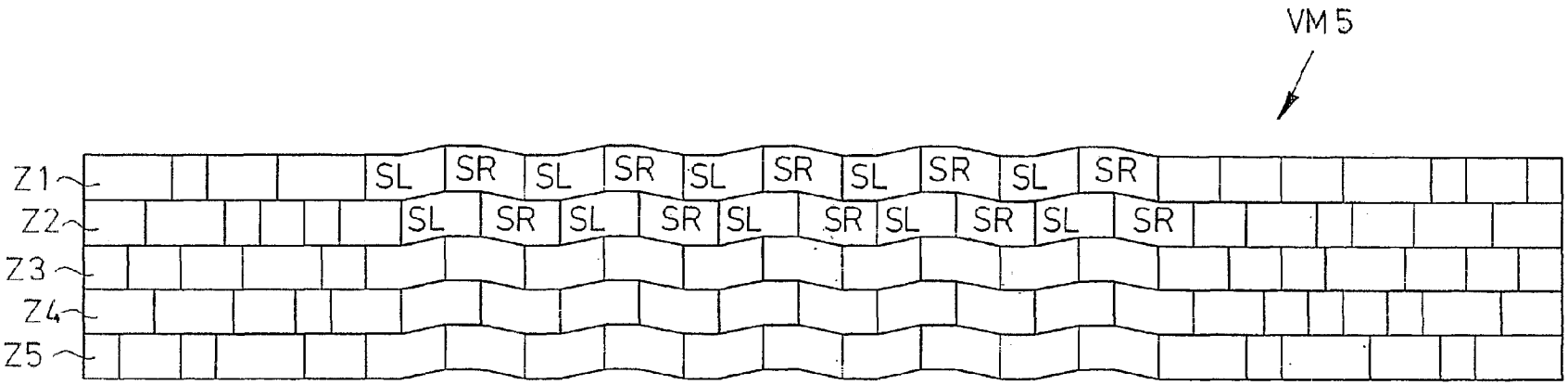
Figure 20:
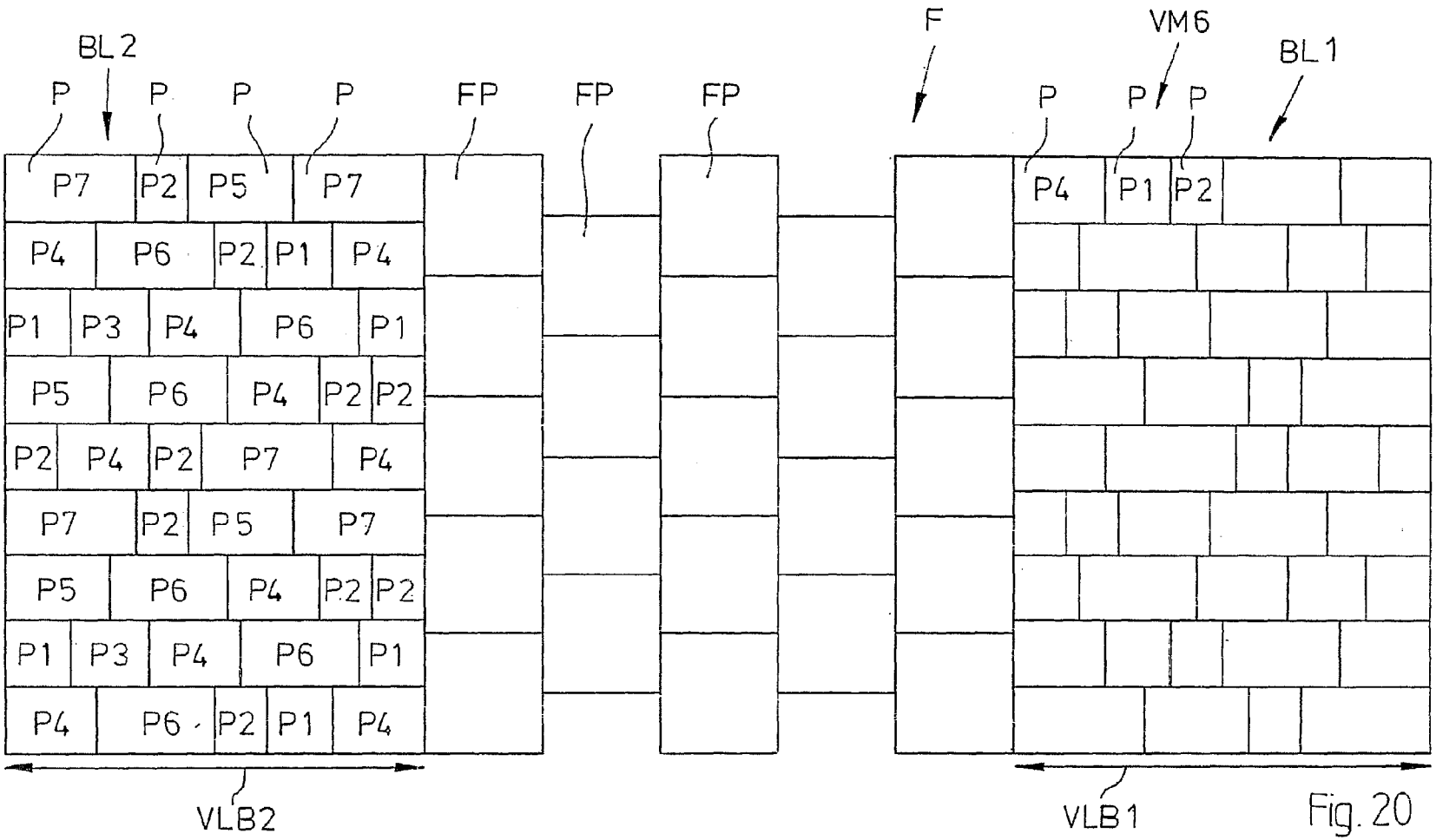
Figure 21:
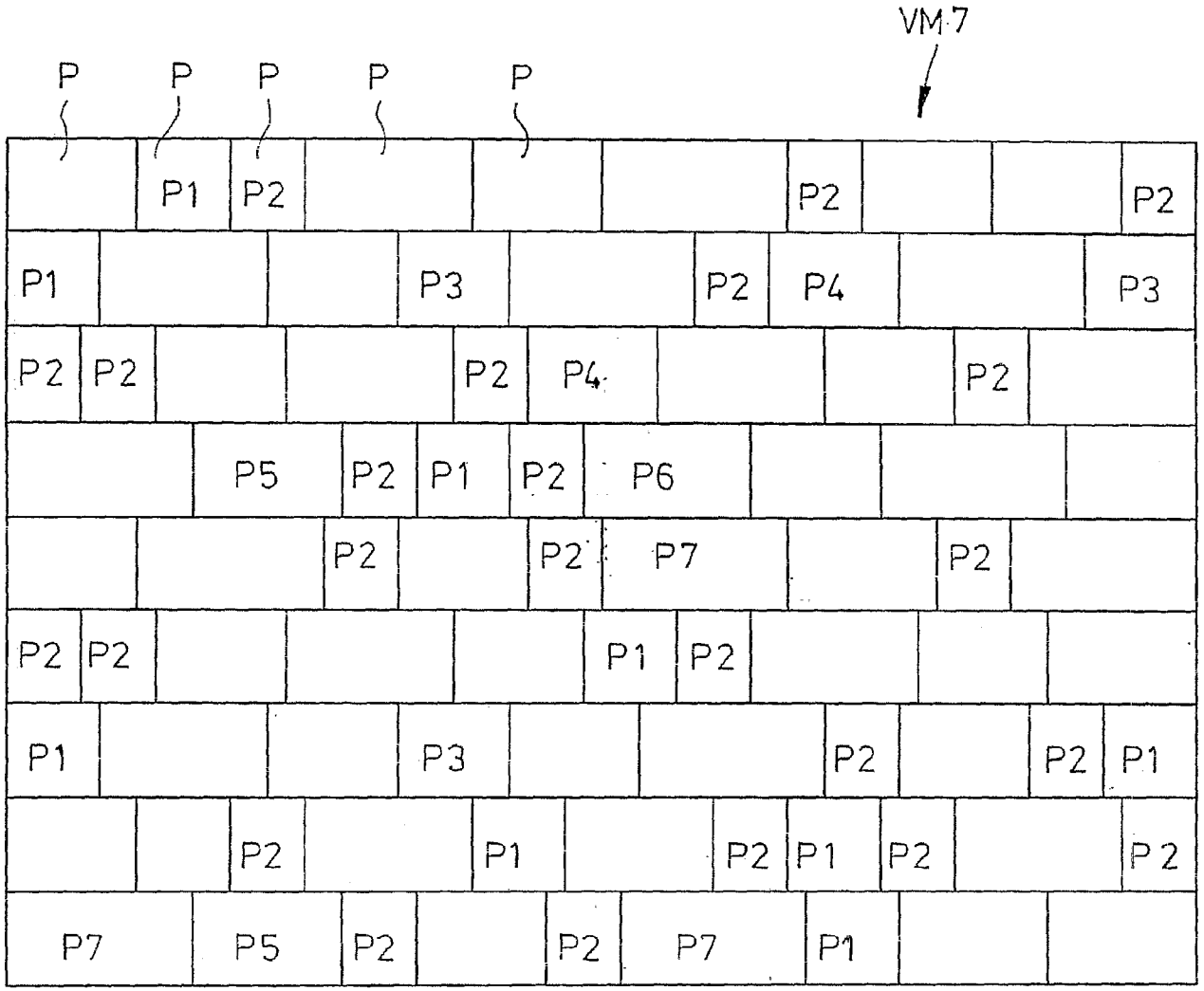

Further laying patterns VM2 to VM7 are illustrated in plan view in FIGS. 16 to 21, the individual paving stones P being illustrated schematically by their respective grid edges. The laying pattern VM2 shown in FIG. 16 is embodied as a wave W, an offset being achieved by laying paving stones P of the paving stone types SL or SR alternately in a column SP1 or SP2 in a fashion displaced from one another by 180° in each case. The laying pattern VM3 that is shown in FIG. 17 is formed exclusively from paving stones P of the paving stone type SL. The paving stones P are laid in rows Z1, Z3, Z5 in respectively the same orientation, and laid in an orientation rotated by 180° in rows Z2, Z4 lying therebetween. The laying pattern VM4 that is illustrated in FIG. 18 shows a design variant of the laying pattern VM2, the laying pattern VM4 showing a more pronounced wave W that is achieved by additional columns SP3, SP4 that correspond in design to columns SP1 and SP2, respectively, and consist of paving stones P of the paving stone type SL. The laying pattern VM5 shown in FIG. 19 is characterized by rows Z1 to Z5 that are formed by alternately consecutive paving stones P of the paving stone types SL and SR. In the laying pattern VM6 illustrated in FIG. 20, paving stones P of the paving stone types P1 to P7 are laid in two blocks BL1 and BL2 with laying widths VLB1 and VLB2 bordering a field F laid from paving stones FP of different type that are square and arranged in an offset fashion. Finally, the laying pattern VM7 illustrated in FIG. 21 is embodied in such a way that exclusively T joints, and no cross joints, are produced. To this end, paving stones P of paving stone types P1 to P7 are used.

Figure 22:
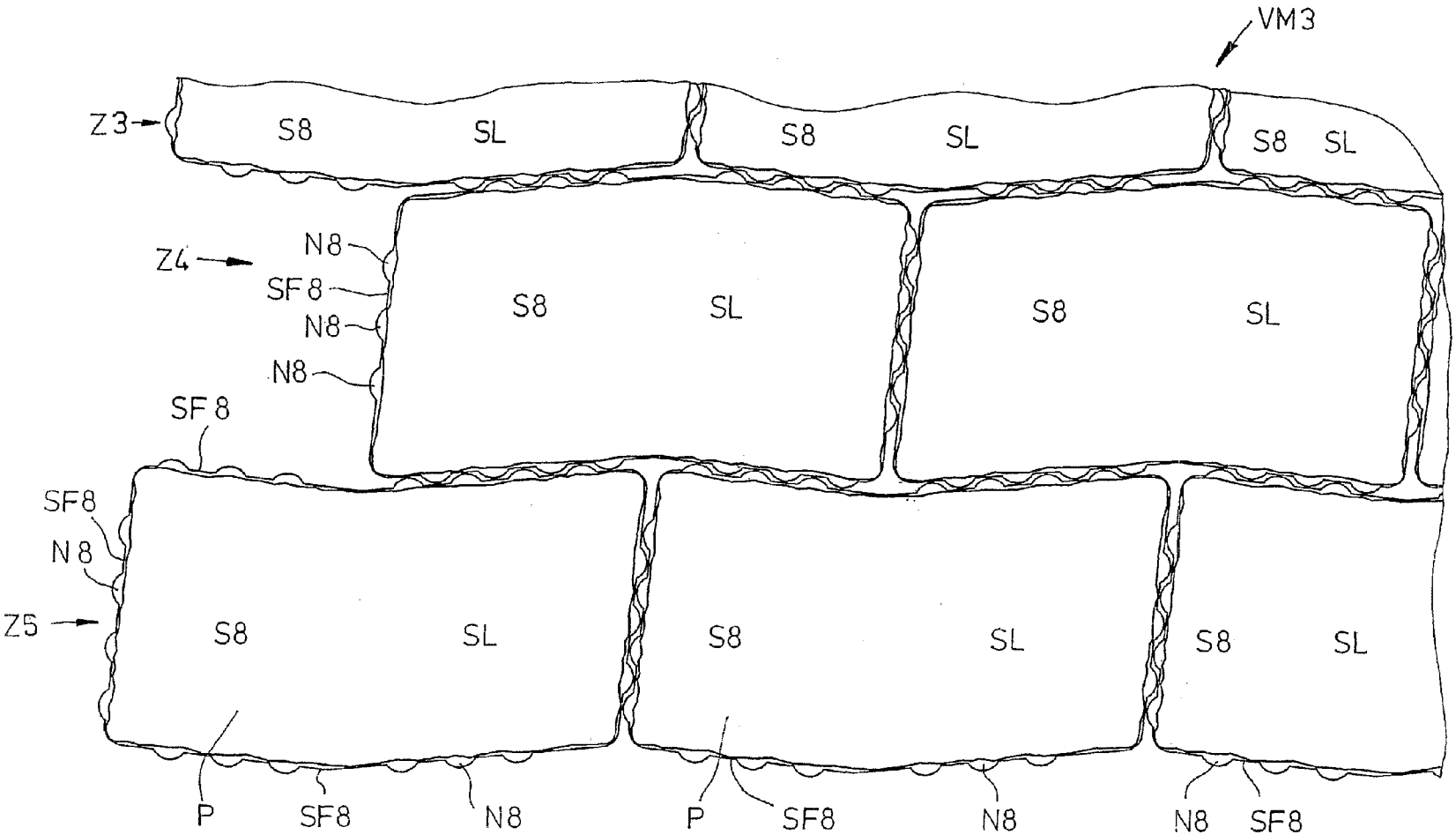
FIG. 22 shows a detailed view of the laying pattern illustrated in FIG. 17.

Finally, FIG. 22 illustrates an enlarged section of the laying pattern VM3 shown in FIG. 17, the individual paving stones P of the paving stone type SL being illustrated not by their theoretical grid edges, but by their actual plan view with side surfaces SF8, ribs N8 and visible sides S8.

Figure 23:
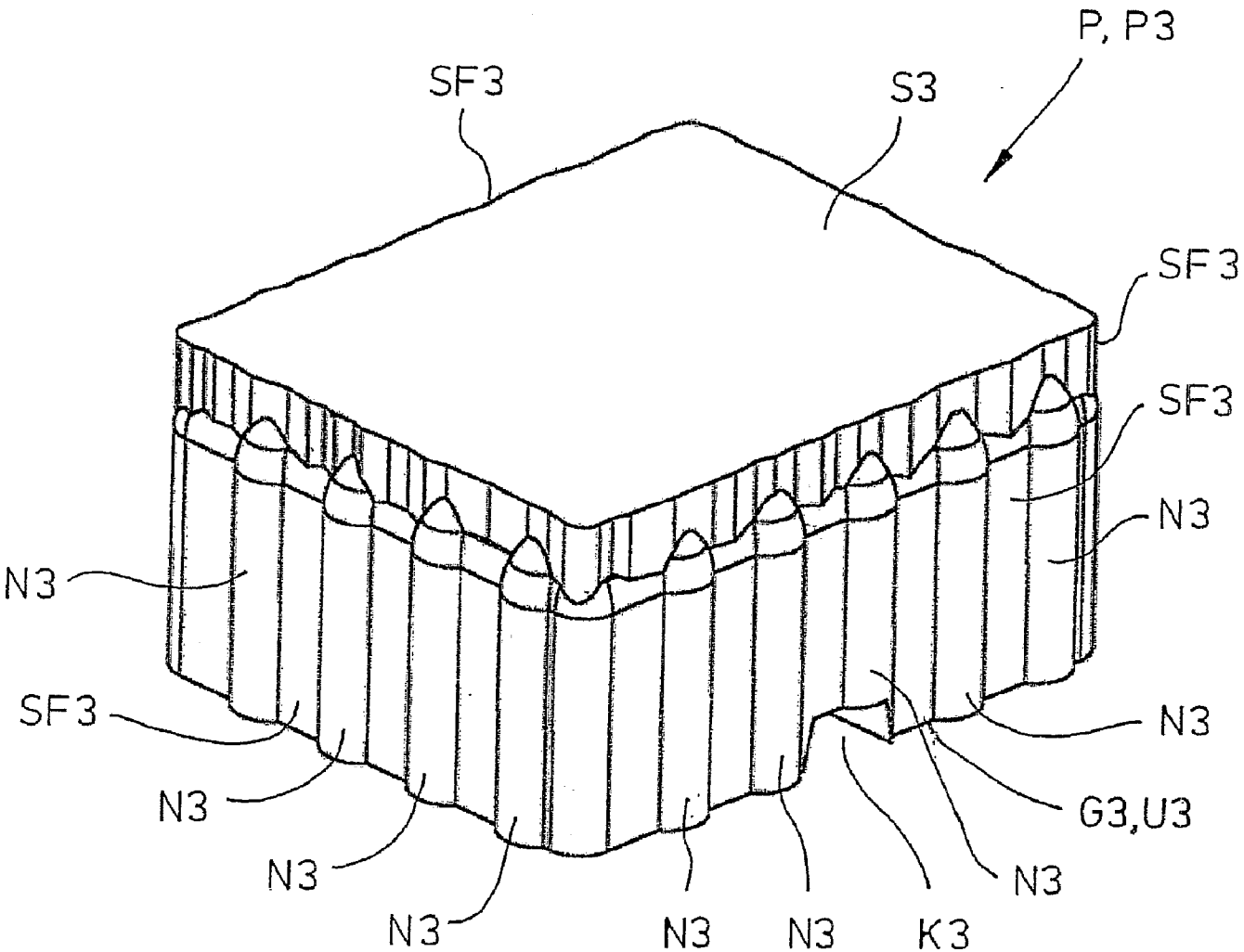
FIG. 23 shows a perspective view of a paving stone type P3 with a channel.

FIG. 23 illustrates a paving stone P of a third paving stone type P3 in a perspective view. The paving stone type P3 has a substantially square base surface G3, four side surfaces SF3 and a visible side S3. Four and five ribs N3 are respectively arranged on opposite side surfaces SF3. The base surface G3 forms an underside U3 that has a channel K3 that opens to the underside U3 and to the opposite side surfaces SF3, which show five ribs N3.

Figure 24:
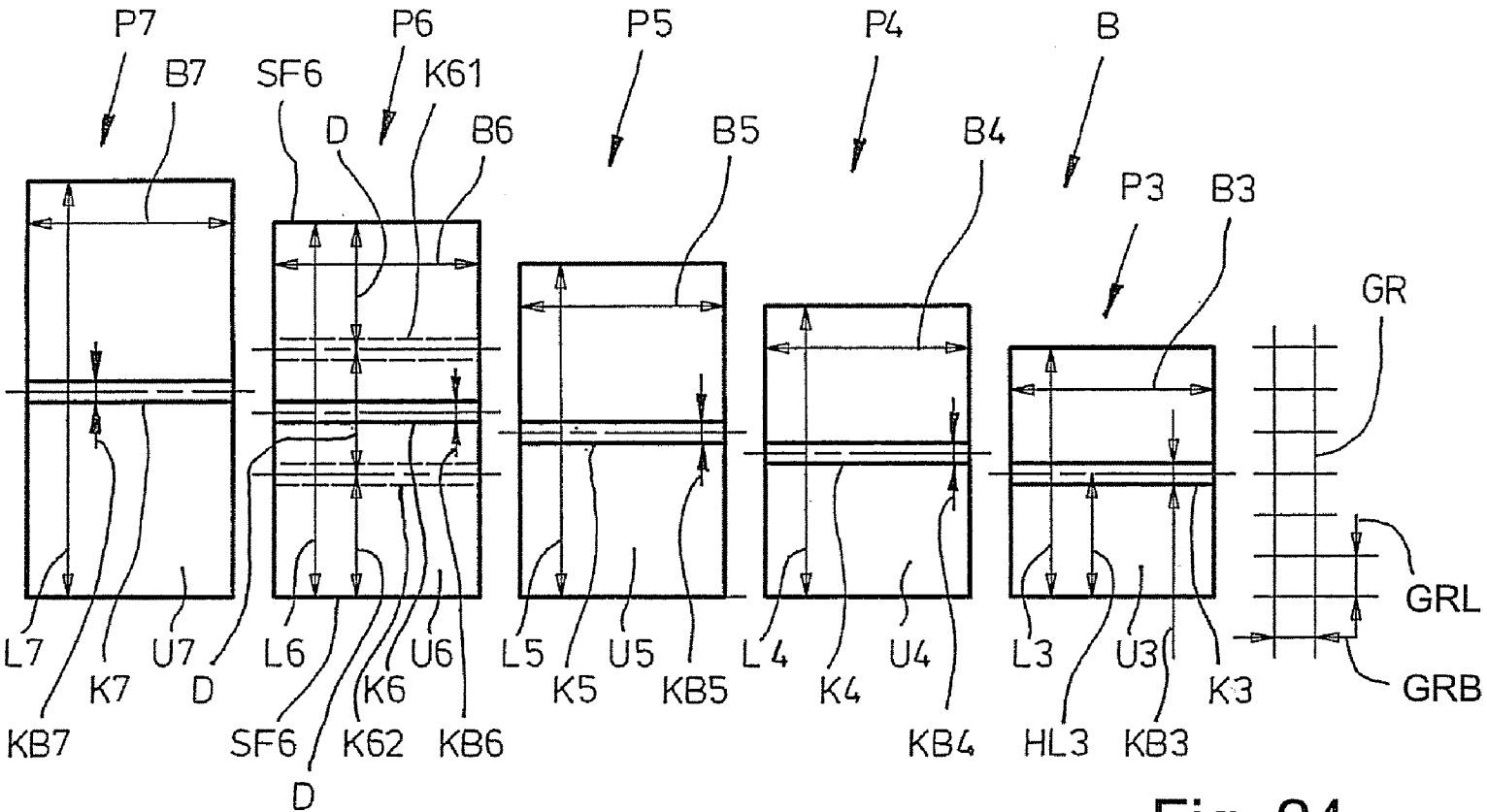
FIG. 24 shows schematic plan views of paving stone types P3 to P7 with channel.

FIG. 24 illustrates five paving stone types P3 to P7 of a set B in a schematic fashion looking onto the undersides U3 to U7 thereof. These paving stone types P3 to P7 have the same widths B3 to B7 and different lengths L3 to L7. Channels K3 to K7 run in the direction of the widths B3 to B7, and respectively halve the lengths L3 to L7. Referred to the basic grid GR, the channels K3 to K7 have a width KB3-KB7 of half a basic grid length GRL=2.8 cm/2=1.4 cm. It is ensured in the case of such dimensioning of the channel width that the channels K3 to K7 have a complete offset relative to one another even when two neighboring rows of stones of a paved surface begin with pairs of stones P3, P4 or P4, P5 or P5, P6 or P6, P7. The undesired formation of a channel network is thus prevented thereby. As described above, the known pairs of stones respectively have a difference in length that corresponds to a basic grid length GRL=2.8 cm. In accordance with a design variant not illustrated, a maximum width KB3-KB7 of the channels K3 to K7 of a basic grid length GRL (2.8 cm) is provided. Consequently, the formation of a baffle-free channel network is also prevented in the laying situation outlined above, since such a dimensioning of the channels leads to a covering of only at most half. In the case of the paving stone type P6, two channels K61 and K62 are illustrated with dashed lines as an alternative to the centrally arranged channel K6. Relative to parallel side surfaces SF6 and to one another, the lines respectively have spacings D that correspond to half the length (HL3) of the paving stone type P3. Furthermore, the set B comprises paving stone types P1 and P2 as these are illustrated in FIG. 3.

Figure 25:
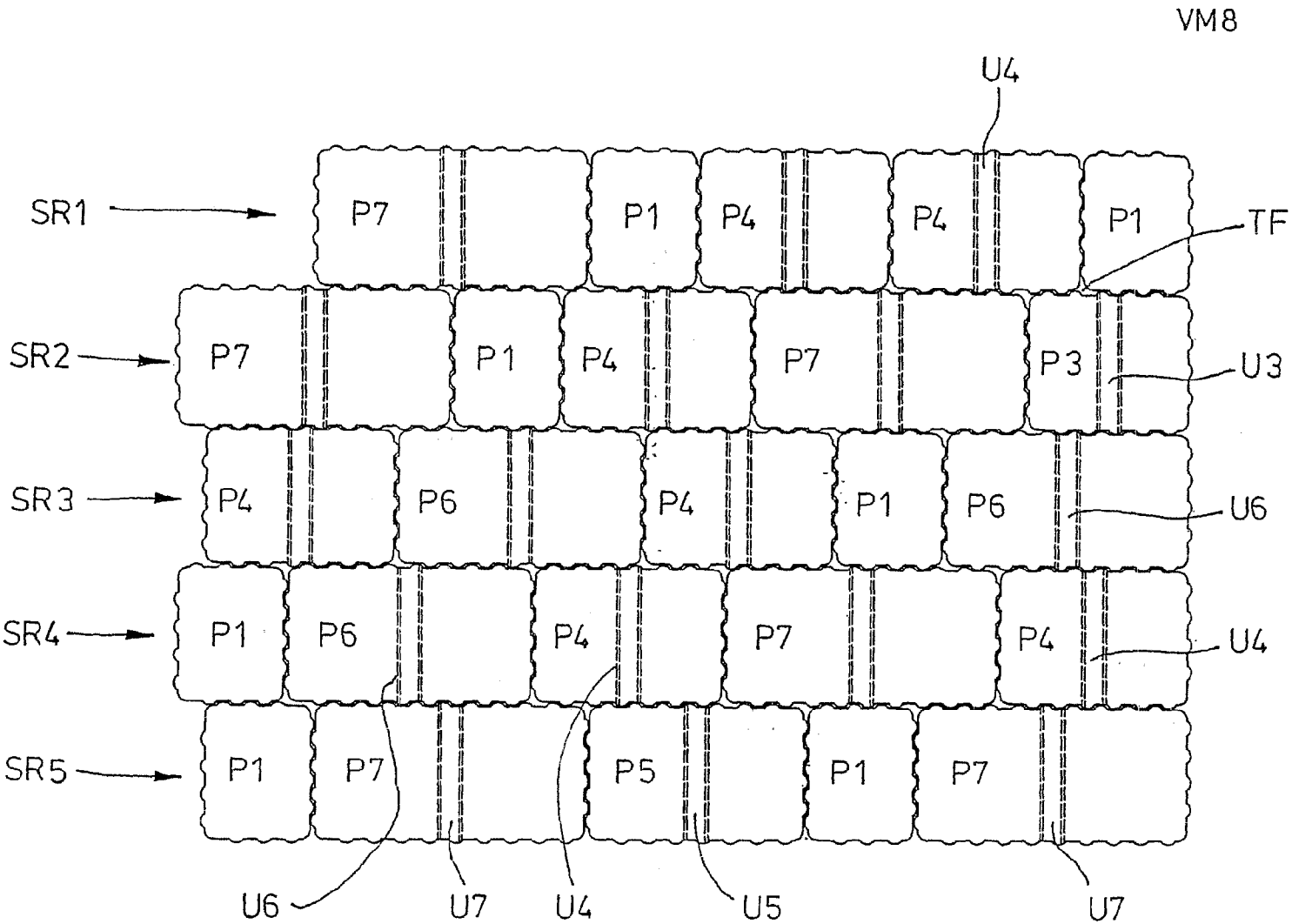
FIG. 25 shows a schematic illustration of a laying pattern having paving stone types with channel.

Finally, FIG. 25 illustrates schematically a section of a laying pattern VM8 that comprises paving stone types P3 to P7 shown in FIG. 24. A paving stone type P1 known from FIG. 3 is also laid by way of supplement. Only T joints TF, and no cross joints, are respectively produced between the individual paving stones. Consequently, none of the drain channels U3 to U7 extend into a respectively neighboring row of stones SR1-SR5.

Figure 26B:
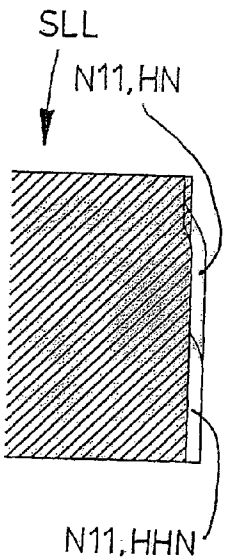
FIGS. 26*a*-26*b* show a plan view of a special stone type SLL and a section through the latter.
Figure 26A:
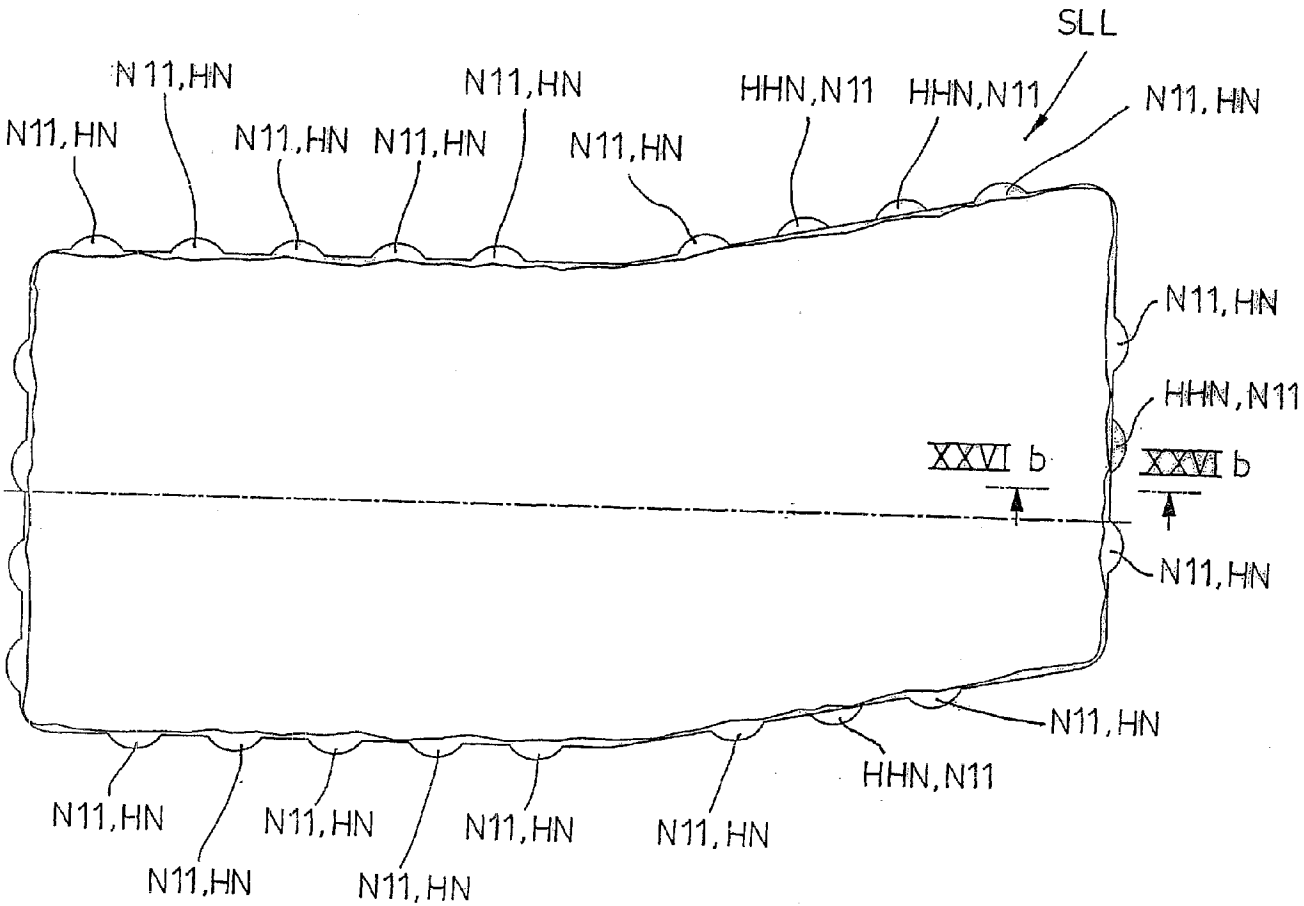
Figure 27B:
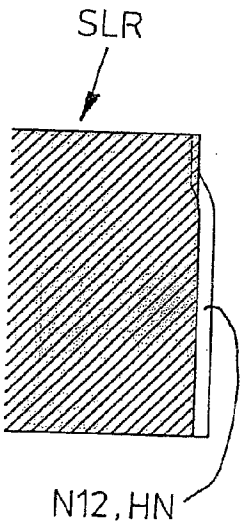
FIGS. 27*a*-27*b* show a plan view of a special stone type SLR and a section through the latter.
Figure 27A:
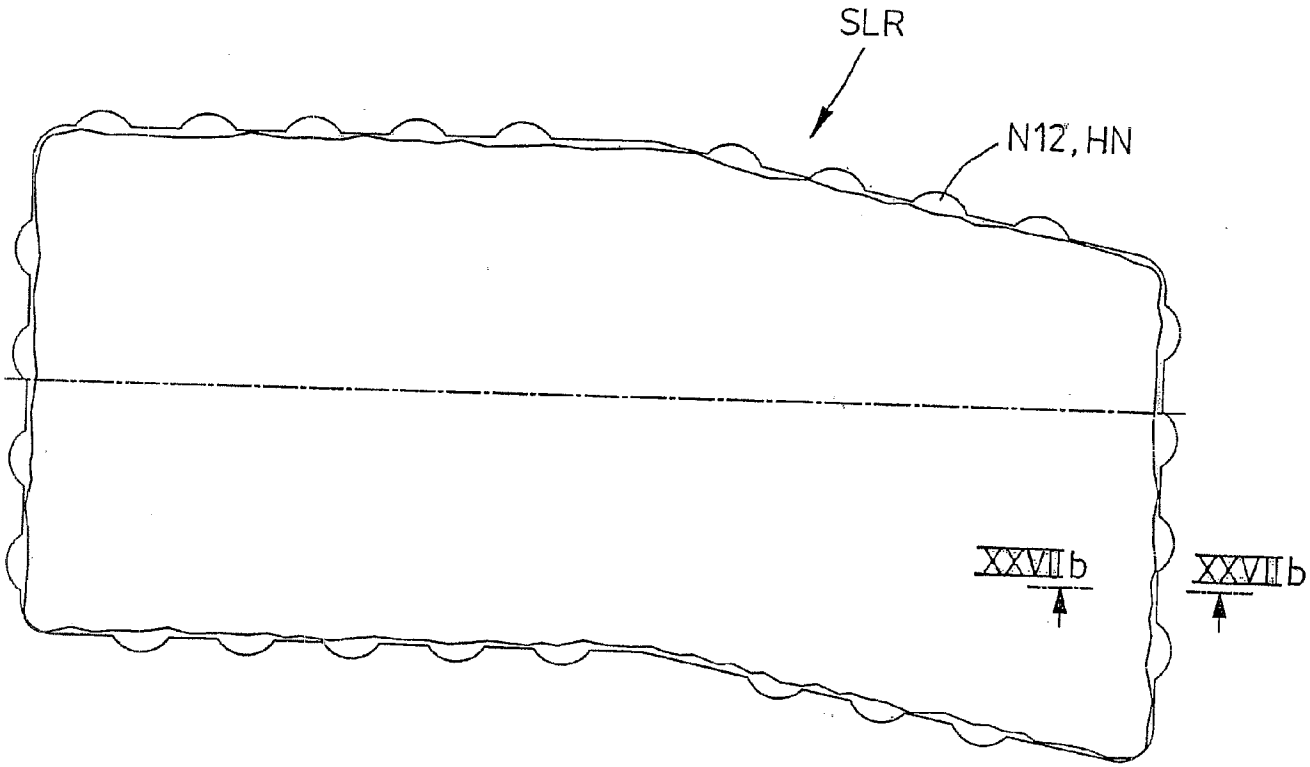

FIG. 26*a* illustrates a plan view of a special stone type SLL that has the dimensions of the special stone type SLL schematically illustrated in FIG. 4. The special stone type SLL is embodied in a fashion fundamentally comparable to the special stone types illustrated in FIGS. 2, 13 and 14. The special stone type SLL has as a special feature ribs N11 that are embodied as high ribs HN and half-height ribs HHN. Consequently, the special stone type SLL can easily be distinguished during laying from a special stone type SLR that is illustrated in FIGS. 27*a* and 27*b* and has exclusively high ribs. FIG. 26*b* shows a section along a section line XXVIb-XXVIb, illustrated in FIG. 26*a*, through the special stone type SLL. The different heights of the high ribs HN and the half-height ribs HHN can be recognized in this sectional view.

FIG. 27*a* illustrates a plan view of the abovementioned special stone type SLR, which has the dimensions of the special stone type SLR illustrated schematically in FIG. 4. The special stone type SLR is likewise embodied in a fashion fundamentally comparable to the special stone types illustrated in FIGS. 2, 13 and 14, and is provided for the purpose of being laid together with the special stone type SLL illustrated in FIG. 26*a*. As distinguished from the special stone type SLL illustrated in FIG. 26*a*, all ribs N12 are designed as high ribs HN in the case of the special stone type SLR. FIG. 27*b* shows a section along a section line XXVIIb-XXVIIb, illustrated in FIG. 27*a*, through the special stone type SLR.

The invention is not restricted to exemplary embodiments illustrated or described. Rather, it comprises developments of the invention within the scope of the patent claims. In particular, the invention also provides that all paving stone types P1 to P7 and SL and SR are designed as lawn stones.

LIST OF REFERENCE SYMBOLS

B Set
B1-B12 Width
BL1, BL2 Block
D Spacings between K61 and K62
E10 Lawn stone type
F Field of paving stones of different type
FP Paving stone of different type
FR Fine grid
FRB Fine grid width
FRL Fine grid length
G1-G9 Base surface of P1-P7, SL, SR
GR Basic grid
GRB Basic grid width
GRL Basic grid length
HL3 Half length of L3
HN High rib HHN Half-height rib
K3-K7 Channel of P3-P7
KB3-KB7 Width of K3-K7
L1-L12 Length
LREB, LRE9 Length of RE8, RE9
LRE11, LRE12 Length of RE11, RE12
LPA8, LPA9 Length of PA8, PA9
LPA11, LPA12 Length of PA11, PA12
LRF Longitudinal grid factor
N1-N12 Ribs of P1-P7, SL, SR, E10
P Paving stone
PA8, PA9 Parallelogram on SL, SR
PA11, PA12 Parallelogram on SLL, SLR
P1-P7 Paving stone type
QRF Transverse grid factor
RE8, RE9 Rectangle on SL, SR
RE11, RE12 Rectangle on SLL, SLR
RK1-RK10 Grid edge
S1-S9 Visible side of P1-P7, SL, SR
SF1-SF9 Side surface of P1-P7, SL, SR
SL, SR Special stone type
SLL, SLR Special stone type
SP1, SP2 Column in laying pattern
SR1-SR5 Row of stones of VM8
TF T joint
U3-U7 Underside of P3-P7
VLB1, VLB2 Laying widths of BL1 and BL2, respectively
VM1-VM8 Laying pattern
W Wave
Z1-Z5 Row in laying pattern
ZNL Number of ribs on the longitudinal side
ZNQ Number of ribs on the transverse side
t Division factor
m Integral multiple
n Integral multiple
p Integral multiple
q Integral multiple
α Tilt angle on PA8, PA9

I claim:

1. A set of paving stones comprising a plurality of different paving stones, each respectively having a polygonal base surface, side surfaces with ribs, and a visible side, the set consisting of:

a plurality of first paving stones, each having a square base surface defining a basic grid GR, and having a width corresponding to a basic grid width GRB and a length corresponding to a basic grid length GRL;

a plurality of second paving stones and a plurality of third paving stones, each having a rectangular base surface whose respective widths correspond to the basic grid width GRB, wherein a length of the base surfaces of the second paving stones corresponds to an integral multiple (n) of one fifth of the basic grid length GRL, wherein n<5, and wherein a length of the base surfaces of the third paving stones corresponds to an integral multiple (m) of one fifth of the basic grid length GRL, wherein m>5; and a plurality of special paving stones including a left-hand type of special paving stones and a right-hand type of special paving stones, wherein the special paving stones each respectively include a rectangular base surface portion having a width that corresponds to the basic grid width GRB, and a parallelogram base surface portion extending from the rectangular base surface portion and having a length that corresponds to the basic grid length GRL.

2. The set of claim 1, wherein lengths of the rectangular base surface portions of a first group of the left-hand and right-hand types of the special paving stones correspond to three times one fifth of the basic grid length GRL.

3. The set as claimed in claim 1, wherein lengths of the rectangular base surface portions of a second group of the left-hand and right-hand types of the special paving stones correspond to six times one fifth of the basic grid length GRL.

4. The set of claim 1, wherein a tilt angle (α) of the respective parallelogram base surface portions is at least 10°.

5. The set of claim 1, wherein a number of the ribs on a longitudinal side surface of one of the first through third paving stones is one less than a respective longitudinal grid factor LRF.

6. The set of claim 1, wherein a number of the ribs on a transverse side surface of one of the first through third paving stones is one less than a respective transverse grid factor QRF.

7. The set of claim 1, wherein the third paving stones have a channel, formed on an underside defining the base surface thereof, that runs transverse to a direction of the basic grid length GRL and which is centrally aligned relative to the respective lengths of the third paving stones.

8. The set of claim 1, wherein the channel has a width of 1.4 cm.

9. The set of claim 1, wherein the width and length of the base surfaces of the first paving stones are between 10 cm and 16 cm.

10. The set of claim 1, wherein the base surfaces of each of the first paving stones have a width of 14 cm and a length of 14 cm.

11. The set of claim 1, wherein the base surfaces of each of the first paving stones have a width of 15 cm and a length of 15 cm.

* * * * *